US010400540B2

(12) United States Patent
Williamson et al.

(10) Patent No.: US 10,400,540 B2
(45) Date of Patent: Sep. 3, 2019

(54) WELLBORE FLOW DIVERSION TOOL UTILIZING TORTUOUS PATHS IN BOW SPRING CENTRALIZER STRUCTURE

(71) Applicant: KLX ENERGY SERVICES LLC, Houston, TX (US)

(72) Inventors: Scott Earl Williamson, Castle Rock, CO (US); Michael R. Dedman, Edgar, MT (US)

(73) Assignee: KLX ENERGY SERVICES LLC, Houston, TX (US)

( * ) Notice: Subject to any disclaimer, the term of this patent is extended or adjusted under 35 U.S.C. 154(b) by 173 days.

(21) Appl. No.: 15/438,815

(22) Filed: Feb. 22, 2017

(65) Prior Publication Data

US 2017/0241232 A1 Aug. 24, 2017

Related U.S. Application Data

(60) Provisional application No. 62/299,076, filed on Feb. 24, 2016.

(51) Int. Cl.

| | |
|---|---|
| ***E21B 17/10*** | (2006.01) |
| ***E21B 33/127*** | (2006.01) |
| ***E21B 34/10*** | (2006.01) |
| ***E21B 33/12*** | (2006.01) |
| ***E21B 33/126*** | (2006.01) |
| ***E21B 43/26*** | (2006.01) |

(52) U.S. Cl.

CPC ..... *E21B 33/1208* (2013.01); *E21B 17/10* (2013.01); *E21B 33/126* (2013.01); *E21B 34/10* (2013.01); *E21B 43/26* (2013.01)

(58) Field of Classification Search

CPC .... E21B 34/06; E21B 43/103; E21B 33/1208; E21B 17/10

See application file for complete search history.

(56) References Cited

U.S. PATENT DOCUMENTS

| | | | | |
|---|---|---|---|---|
| 3,760,877 A | | 9/1973 | De Lajarte et al. | |
| 4,576,042 A | * | 3/1986 | Johnson | E21B 47/10 73/152.36 |
| 6,065,500 A | * | 5/2000 | Metcalfe | E21B 43/086 138/118 |

(Continued)

FOREIGN PATENT DOCUMENTS

GB 640285 A 7/1950

OTHER PUBLICATIONS

PCT Search Report and Written Opinion issued for related application PCT/US2017/018784, dated May 31, 2017, 7 pages.

*Primary Examiner* — Robert E Fuller
*Assistant Examiner* — Theodore N Yao
(74) *Attorney, Agent, or Firm* — Drinker Biddle & Reath LLP

(57) ABSTRACT

An apparatus for at least partially sealing an annulus of a wellbore comprises a hollow mandrel pipe adapted to attach to a tubing string, and a cylindrical cage surrounding and attached to an exterior length of the mandrel pipe, the cylindrical cage having a plurality of generally lengthwise tortuous path apertures generally parallel with one another between the two open ends of the mandrel pipe, the plurality of generally lengthwise tortuous path apertures defining a plurality of bow springs therebetween, the plurality of bow springs bowed outward from the mandrel pipe.

15 Claims, 13 Drawing Sheets

(56) References Cited

U.S. PATENT DOCUMENTS

| | | | | |
|---|---|---|---|---|
| 6,695,067 | B2 * | 2/2004 | Johnson | E21B 33/128 166/195 |
| 7,721,799 | B2 * | 5/2010 | Baski | E21B 34/10 166/101 |
| 2005/0150653 | A1 | 7/2005 | Hall et al. | |
| 2010/0078173 | A1 * | 4/2010 | Buytaert | E21B 17/1014 166/302 |
| 2012/0217013 | A1 * | 8/2012 | O'Malley | E21B 17/10 166/308.1 |
| 2014/0158350 | A1 * | 6/2014 | Castillo | E21B 23/10 166/250.17 |
| 2014/0182839 | A1 | 7/2014 | McDaniel et al. | |
| 2015/0114639 | A1 | 4/2015 | Williamson et al. | |
| 2015/0152704 | A1 * | 6/2015 | Tunget | E21B 33/128 166/254.2 |
| 2015/0322962 | A1 * | 11/2015 | Paoletti | C23C 18/1698 166/75.11 |
| 2016/0047209 | A1 * | 2/2016 | Castillo | E21B 23/08 166/386 |
| 2016/0097252 | A1 * | 4/2016 | Resink | E21B 33/126 166/387 |
| 2017/0145780 | A1 * | 5/2017 | Castro | E21B 23/01 |
| 2017/0260816 | A1 * | 9/2017 | Martin | E21B 17/1028 |
| 2017/0342797 | A1 * | 11/2017 | Murphree | E21B 33/1208 |

* cited by examiner

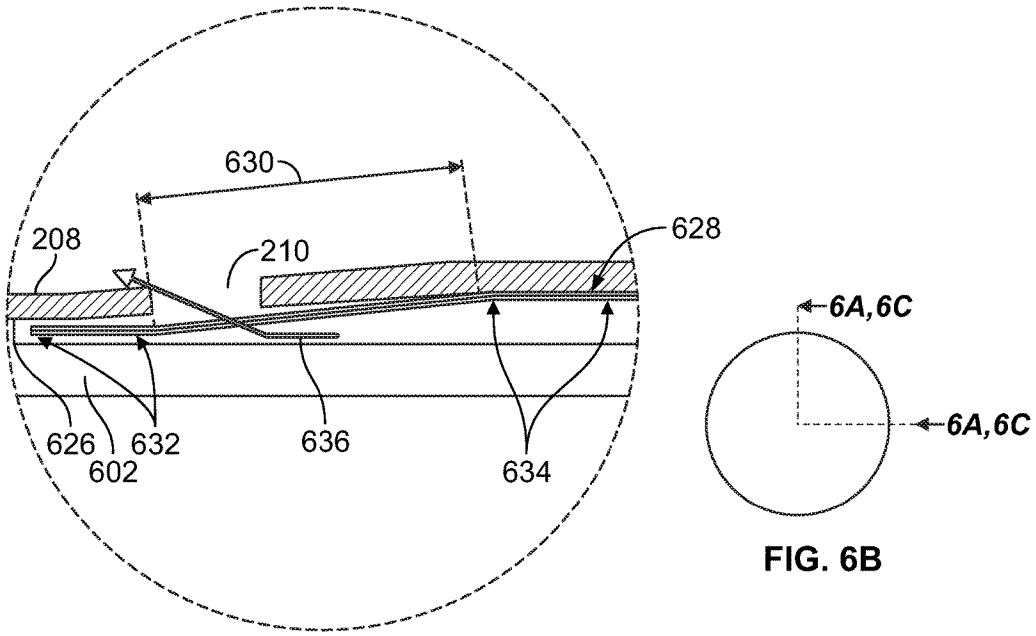
FIG. 6B
FIG. 6D
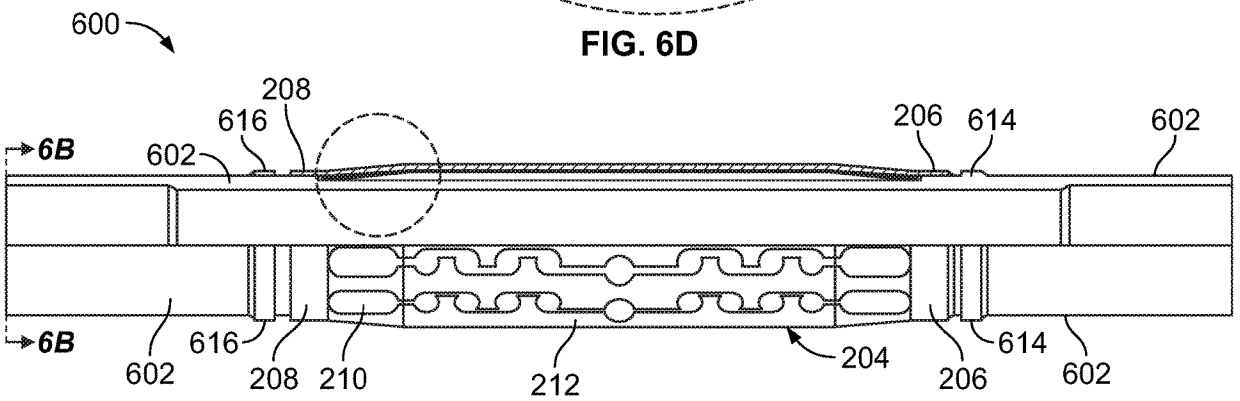
FIG. 6A

WELLBORE FLOW DIVERSION TOOL UTILIZING TORTUOUS PATHS IN BOW SPRING CENTRALIZER STRUCTURE

CROSS-REFERENCES TO RELATED APPLICATIONS

This application claims the benefit of U.S. Provisional Patent Application No. 62/299,076, entitled "Wellbore Flow Diversion Tool Utilizing Tortuous Paths In Bow Spring Centralizer Structure," filed on Feb. 24, 2016, which is hereby expressly incorporated herein by reference in its entirety.

BACKGROUND

1. Field

One or more embodiments relate to wellbore flow diversion tools, and more particularly, to a wellbore flow diversion tool utilizing tortuous paths in a bow spring centralizer structure.

2. Description of the Related Art

Virtually every well drilled in shale experiences production decline, largely due to the limited effectiveness of methods by which the source rock (shale) is hydraulically fractured (frac'd) in an effort to provide channels for the oil to flow to the well bore. The future of the oil industry will rely heavily on the ability to re-stimulate sections of horizontal shale oil wells which have already been drilled and stimulated (frac'd) during the wells' completion phase. In virtually every case, steel pipe (parent pipe) lines the open bore hole for stability and it is permanently in place, stuck by sand or cemented from the initial completion of the well.

In many cases after oil production in a well has depleted, the well can be partially or possibly fully restored to original completion oil production levels by re-frac'ing the well bore. If done correctly, this is like getting two oil wells for the price of one, and represents a large cost savings compared to drilling an entirely new oil well. In some instances, a parent pipe has been broken from stress or eroded from frac sand, and has lost pressure integrity. Many wells have not been completed because in early stages the parent pipe (usually at the heel of the well) has failed and frac'ing operations have been halted, leaving much of the well in an uncompleted stage.

How the well was completed initially impacts the ability to restore the well to completion oil production levels. Steel pipe lines the well bore from surface to total depth. This pipe has to be perforated via a "plug 'n' shoot" process or windowed using frac sleeves which are installed in-line on the pipe at intervals where the frac is to be performed. This allows multiple sections of the well bore to be frac'd individually, starting at the toe (bottom) of the well and working up to the curve (heel) of the well. Fifty sections (stages) are not uncommon in a well. Prior to production, a drill bit is run through the steel pipe to clean out the composite plugs or frac sleeve remnants and all of the stages are produced together.

Common sense would indicate that the entire well bore could be treated in one big frac stage, but in practice, many small stages are the only means of controlling the direction, height, and frac fluid volume along the well bore. To re-frac the existing open sections of the pipe, a method is needed to again isolate the open sections from each other and start frac'ing over again from the toe to the heel.

There have been different methods proposed to pressure-isolate sections of the well while individual sections are being re-stimulated at high pressures and flow rates. One method is to use chemicals or cement pumped into the existing holes or windows in the pipe in an effort to plug them. This is expensive and considered high risk in terms of having confidence that the holes or windows are adequately plugged.

Another method is to insert and run a pipe (tubing) barely smaller than the parent pipe into the parent pipe. The tubing includes tools on the end of it that seal the inside of the pipe and straddle the intervals where frac'ing had been performed. Each interval is re-frac'd through the tubing. The tools have inner diameter restrictions which limit the rate of frac fluid injection, which is critical to establish and maintain a fracture in the shale, and present a risk of getting the tools stuck with frac sand.

Other methods include cementing the tubing in place after inserting the tubing barely smaller than the parent pipe into the parent pipe, which has had poor results, or placing isolation devices on the outside of the smaller pipe which seal against the inside of the parent pipe. The isolation devices then contain pressure between them as the zone between them is re-stimulated or frac'd. Fluids used to stimulate may include acids, gels, gases, solvents, etc. Legacy technology exists to seal off the annulus between the larger and smaller pipes at measured intervals using elastomers; however, very thin cross sections of elastomers needed to provide a reasonably large diameter in the smaller pipe have proven to be weak and unreliable. Also, due to the very close inner diameter/outer diameter dimensions, the general practice with elastomers requires downsizing the diameter of the smaller pipe. This creates an unacceptable pressure drop for re-stimulation, especially considering that the smaller pipe will vary in length from one to two and a half miles into the horizontal section of the parent pipe. Wells also have a large volume of debris like sand, cast iron, or fiberglass, which can cause attempts to achieve setting depths with the smaller pipe to fail. In addition, some designs using elastomers in hydraulic set packers require severely restricting the inner diameter of the tubing at the packers and creating bottlenecks, which would be too small for passing composite plugs and perforating guns in the "plug 'n' perf" re-frac method. Another technique using elastomers includes mounting a swellable elastomer between tubing and a parent casing to seal off a section inside of the parent casing. The swellable elastomer swells up in combinations of water or oil-based fluids. In particular applications, e.g., vertical wells, fluid levels are very low and fluid necessary to swell the elastomers is absent. Also, in the vertical and low fluid level wells, a large inner diameter is typically required in order to run production pumps deep enough to reach the oil level.

SUMMARY

The following introduces a selection of concepts in a simplified form in order to provide a foundational understanding of some aspects of the present disclosure. The following is not an extensive overview of the disclosure, and is not intended to identify key or critical elements of the disclosure or to delineate the scope of the disclosure. The following merely presents some of the concepts of the disclosure as a prelude to the more detailed description provided thereafter.

An embodiment of the present disclosure relates to an apparatus for at least partially sealing an annulus of a wellbore, the apparatus comprising: a hollow mandrel pipe having two open ends adapted to attach to a tubing string;

and a cylindrical cage surrounding and attached to an exterior length of the mandrel pipe, the cylindrical cage having a plurality of generally lengthwise tortuous path apertures generally parallel with one another between the two open ends of the mandrel pipe, the plurality of generally lengthwise tortuous path apertures defining a plurality of bow springs therebetween, the plurality of bow springs bowed outward from the mandrel pipe.

Another embodiment of the present disclosure relates to a method of re-stimulating a well using a flow diversion tool, the method comprising: joining a flow diversion tool with a tubing string, the flow diversion tool including: a hollow mandrel pipe having two open ends adapted to attach to the tubing string, and a cylindrical cage surrounding and attached to an exterior length of the mandrel pipe, the cylindrical cage having a plurality of generally lengthwise tortuous path apertures generally parallel with one another between the two open ends of the mandrel pipe, the plurality of generally lengthwise tortuous path apertures defining a plurality of bow springs therebetween, the plurality of bow springs bowed outward from the mandrel pipe; inserting the tubing string joined with the flow diversion tool into a wellbore casing; pumping fluid into a wellbore annulus between the tubing string and the wellbore casing; flowing the pumped fluid through the plurality of tortuous path apertures of the flow diversion tool when the pressure of the pumped fluid is less than a free-flow threshold; and substantially blocking the flow of the pumped fluid through the plurality of tortuous path apertures of the flow diversion tool when the pressure of the pumped fluid is greater than a substantially-blocking threshold.

Further scope of applicability of the apparatuses and methods of the present disclosure will become apparent from the more detailed description given below. However, it should be understood that the following detailed description and specific examples, while indicating embodiments of the apparatus and methods, are given by way of illustration only, since various changes and modifications within the spirit and scope of the concepts disclosed herein will become apparent to those skilled in the art from the following detailed description.

BRIEF DESCRIPTION OF THE DRAWINGS

These and/or other aspects will become apparent and more readily appreciated from the following description of the embodiments, taken in conjunction with the accompanying drawings of which:

FIG. 6A and FIG. 6D illustrate a three quarter section view of a flow diversion tool in a substantially-blocking mode, according to another embodiment.

FIG. 6B illustrates an end view of the flow diversion tool of FIGS. 6A and 6C, according to an embodiment.

Figure 1:
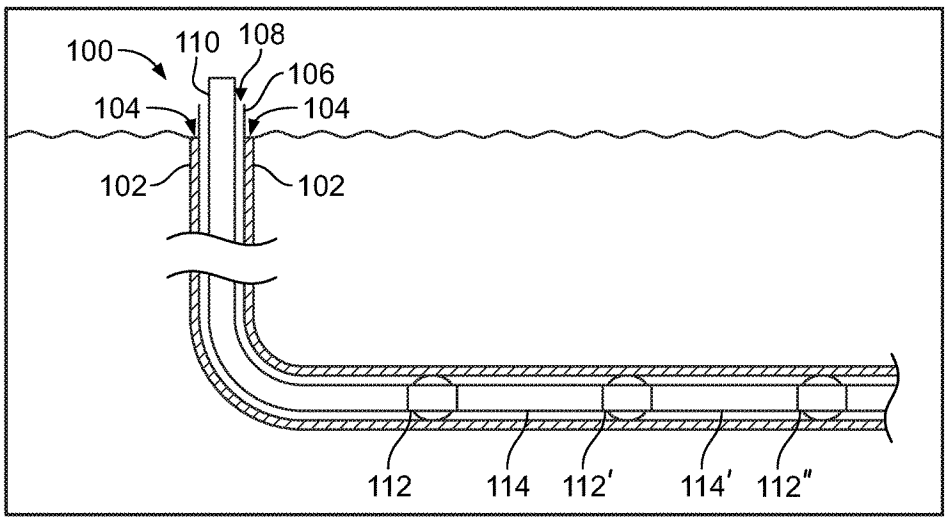
FIG. 1 illustrates a wellbore system including a plurality of wellbore flow diversion tools dispersed along a tubing string for re-fracturing zones of a borehole, according to an embodiment.

The headings provided herein are for convenience only and do not necessarily affect the scope or meaning of what is claimed in the present disclosure.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

One or more embodiments of the present disclosure include a device which can seal the outside of a smaller pipe to the inside of the parent pipe in a wellbore to provide adequate, although not necessarily total, pressure isolation and maintain a large inner diameter, allowing for higher pumping rates at acceptable surface treating pressures than conventional approaches. A perfect seal and total pressure isolation is not needed in practice. So much frac fluid and sand is pumped at a high rate such that a relatively smaller leak rate around the sealing barriers of the embodiments is acceptable. The amount of pressure isolation is adequate when frac'ing can be successfully performed at a target region of the wellbore adjacent the device in spite of any leak rate around the sealing barriers of the device.

As will be described in greater detail below, the wellbore flow diversion tool of the present disclosure is designed to halt fluid flow using an engineered tortuous path as opposed to, for example, elastomeric substitutes such as those used in existing approaches mentioned above. The various features and design of the flow diversion tool described herein offers numerous advantages and benefits over existing techniques for re-stimulating sections of the well bore. For example, the one piece mandrel of the flow diversion tool has no internal threaded connections and is very strong axially, according to an embodiment. The flow diversion tool allows the largest outer diameter (OD) pipe to be run in the well, and the largest inner diameter (ID) provided through the mandrel. Also, the various shapes of the tortuous path provided in the exterior cage of the flow diversion tool improve resistance to flow erosion. In addition, the design of the flow diversion tool is simple and very robust. For example, in accordance with one or more embodiments, the flow diversion tool does not use any pistons, swell elastomers, or externally damageable elastomers, which would limit ID/OD benefits, setting/swelling requirements, etc.

FIG. 1 illustrates a wellbore system 100 including a plurality of wellbore flow diversion tools 112, 112', 112" dispersed along a tubing string 110 at predetermined intervals for re-fracturing zones of a borehole 102, according to an embodiment. The wellbore system 100 may be installed in the earth, for example, thru a shale or oil-bearing rock formation where oil is present and fracturing of the shale rock formation is required to extract the oil from the shale. The borehole 102 may transition from vertical to horizontal at a rate of up to about 10 degrees per 100 feet of length after reaching the depth of the desired shale formation, and then run horizontally through the formation for hundreds to tens of thousands of feet. The end of the borehole 102 is referred to as the toe, while the location of the transition from vertical to horizontal is referred to as the heel of the borehole 102.

The borehole 102 may have a wellbore casing 104, which may include a steel casing, cemented or not cemented on the outside. The wellbore casing 104 includes a wellbore casing inner wall 106 that defines an inner diameter of the wellbore casing. The wellbore casing 104 may be permanently cemented or gravel-packed into the borehole 102. When the borehole 102 is initially stimulated, which begins at the toe of the borehole 102, tools are inserted into the borehole 102 to shoot holes through the wellbore casing 104 into the shale formation and pump a fluid or slurry including sand through the holes into the shale to fracture the shale. The sand in the slurry holds the fractures open to allow oil from within the formation to flow into the wellbore casing 104 to be pumped up to the surface. The sand slurry is injected within a high flow rate range, as understood by one of ordinary skill in the art.

In an embodiment, the inner diameter of the wellbore casing may be about 4 inches, and the outer diameter of the wellbore casing may be about 4.5 inches. All pipes and tools inserted into the wellbore casing 104 for frac'ing and re-frac'ing operations typically have a diameter no greater than the inner diameter of the wellbore casing. The tubing string 110 may be inserted into the wellbore casing 104 for re-frac'ing zones of the borehole 102. The tubing string 110 may include a plurality of the wellbore flow diversion tools 112, 112', 112" separated by a plurality of joints 114, 114'. The wellbore flow diversion tools 112, 112', 112" are operable to isolate a region of wellbore annulus 108 between a pair of the wellbore flow diversion tools 112, 112', 112", e.g., between wellbore flow diversion tools 112 and 112' surrounding joint 114, to pressurize the isolated region of the wellbore annulus 108 relative to other regions of the wellbore annulus 108 (e.g., surrounding joint 114') for re-frac'ing operations. It should be noted that, in accordance with one or more embodiments, the flow diversion tools 112, 112', 112" may operate within a pipe that is suspended inside of the larger casing (e.g., wellbore casing 104) deep in the well. In some applications, such a pipe, which does not extend to the surface of the earth, is referred to as a "liner."

According to an embodiment, the wellbore flow diversion tools 112, 112', 112" may or may not include any elastomers (e.g., may include o-rings or thin rubber coatings on the inside of the umbrella, which is described in further detail below), but the diversion tool/casing contact is a non-elastomeric interface. For example, in an embodiment, the flow diversion tools 112, 112', 112" utilize a metal cage having tortuous paths that touch the wellbore casing inner wall 106 and create a flow diversion. The metal cage of the wellbore flow diversion tools 112, 112', 112" also has a plurality of bow springs forming a bow spring centralizer. In an embodiment, an outer diameter of the bow spring centralizer formed by the plurality of bow springs may be equal to or slightly larger than the inner diameter of the wellbore casing 104. In at least some embodiments, the outer diameter of the metal cage may be slightly smaller than the inner diameter of the wellbore casing 104, such that, when the tool is actuated, the tool expands outward and contacts the inner diameter of the wellbore casing 104. For example, when the bow spring centralizer is energized with pressure, it may expand normally until it contacts the inner diameter of the wellbore casing 104. The flexibility of the bow spring centralizer permits the wellbore flow diversion tools 112, 112', 112" to change their outer diameters to adapt to changes in the inner diameter of the wellbore casing 104 as the wellbore flow diversion tools 112, 112', 112" run through the wellbore casing 104. The tortuous paths permit fluid at low pressures and/or flow rate to flow through while the wellbore flow diversion tools 112, 112', 112" are moved through the wellbore casing 104. But as the fluid flow rate and/or pressure is increased through the wellbore annulus 108 surrounding the wellbore flow diversion tool 112, 112', or 112", the wellbore flow diversion tool 112, 112', or 112" creates a flow restriction which at a substantially-blocking threshold pressure or flow rate adequately halts leakage past the wellbore flow diversion tool 112, 112', or 112", although not necessarily completely. The wellbore flow diversion tools 112, 112', 112" function to create a significant pressure drop from pump rate and pressure applied on either side of the wellbore flow diversion tool 112, 112', 112" in the annulus 108. In an embodiment, each of the wellbore flow diversion tools 112, 112', 112" may be virtually identical on both ends, in the sense that one end is virtually a mirror image of the other end. In some embodiments, however, one end of the wellbore flow diversion tools 112, 112', 112" may differ slightly, at least in operation, from the other end. For example, in an embodiment, one or more of the wellbore flow diversion tools 112, 112', 112" may be configured to work uni-directionally. An example is where a long internal umbrella of the flow diversion tool fills with pressure from one end only, but allows fluid bypass flow from the other end.

Figure 2:
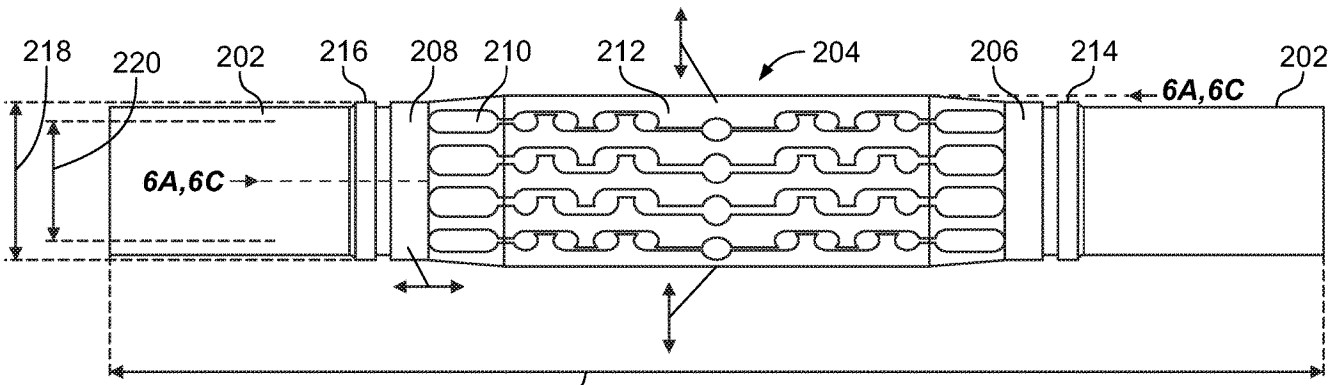
FIG. 2 illustrates a flow diversion tool, according to an embodiment.
Figure 3B:
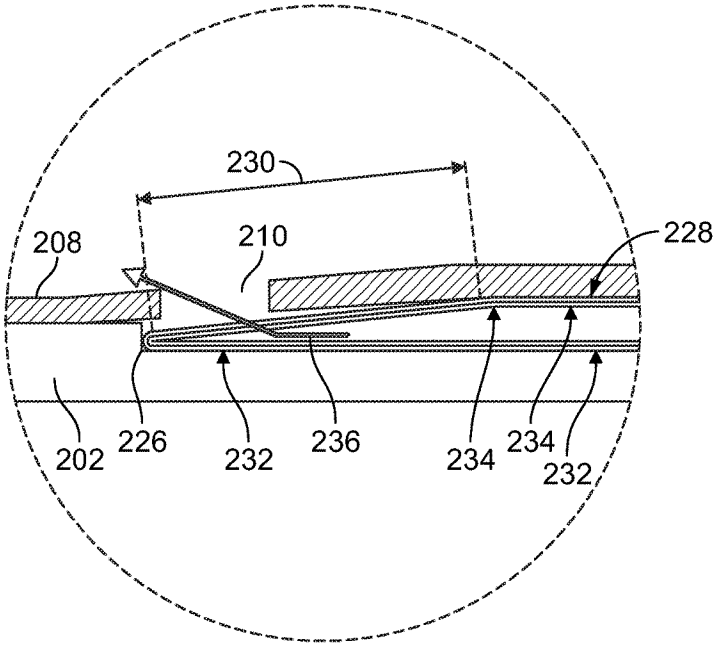
FIG. 3A and FIG. 3B illustrate a longitudinal cross section of the flow diversion tool of FIG. 2, according to an embodiment.
Figure 3A:
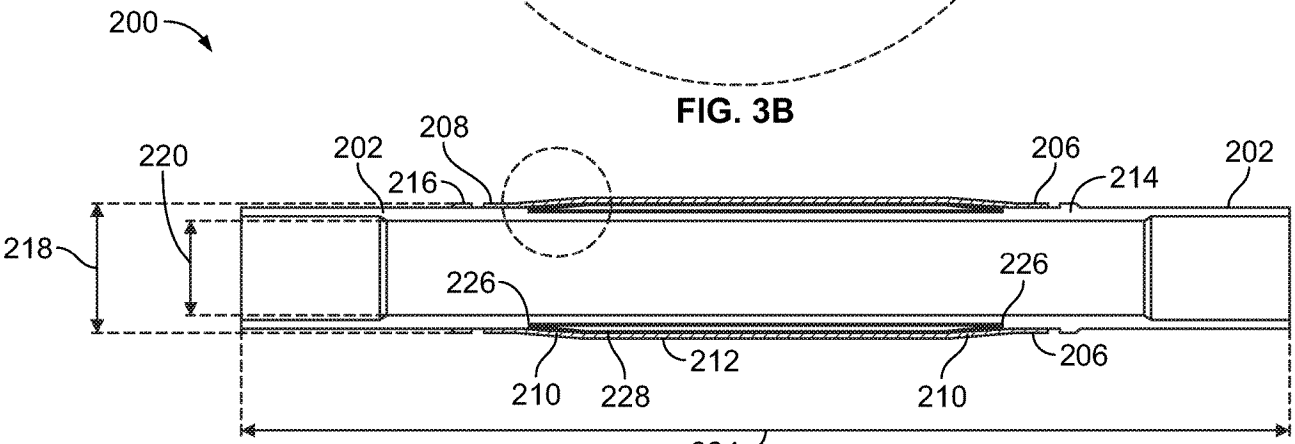
Figure 4:
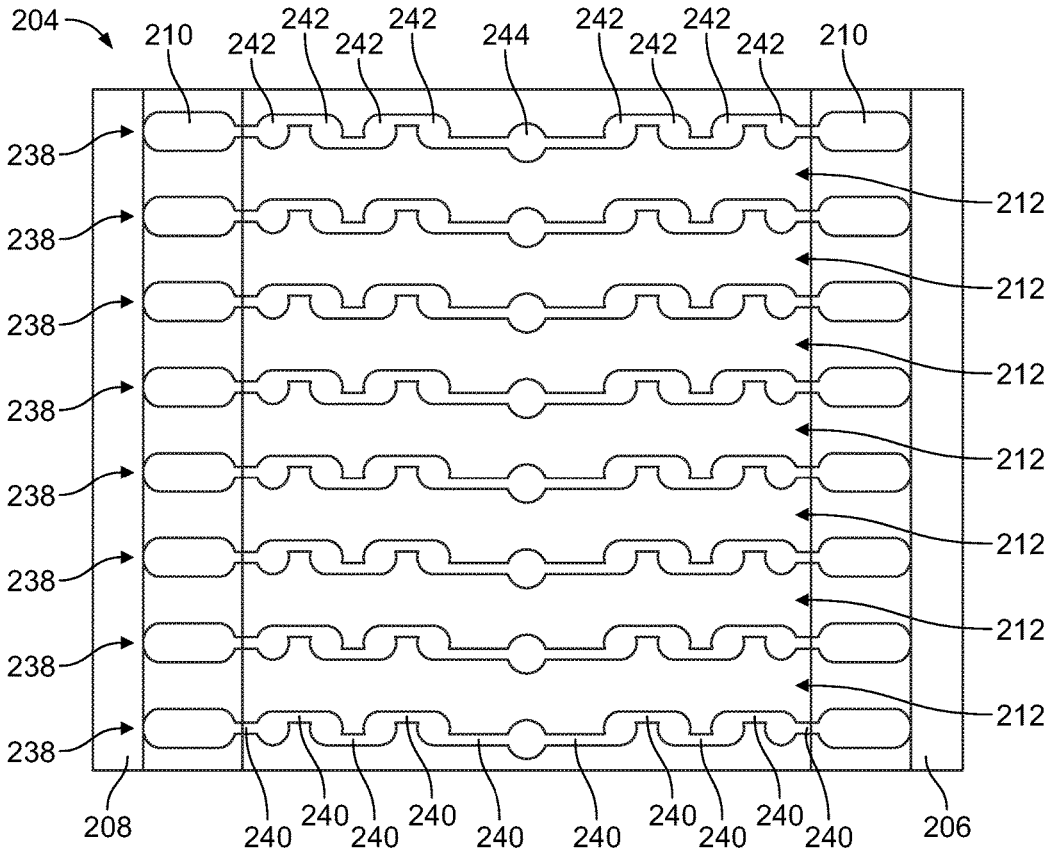
FIG. 4 illustrates a rollout representation of the exterior cage of the flow diversion tool of FIG. 2, according to an embodiment.
Figure 5B:
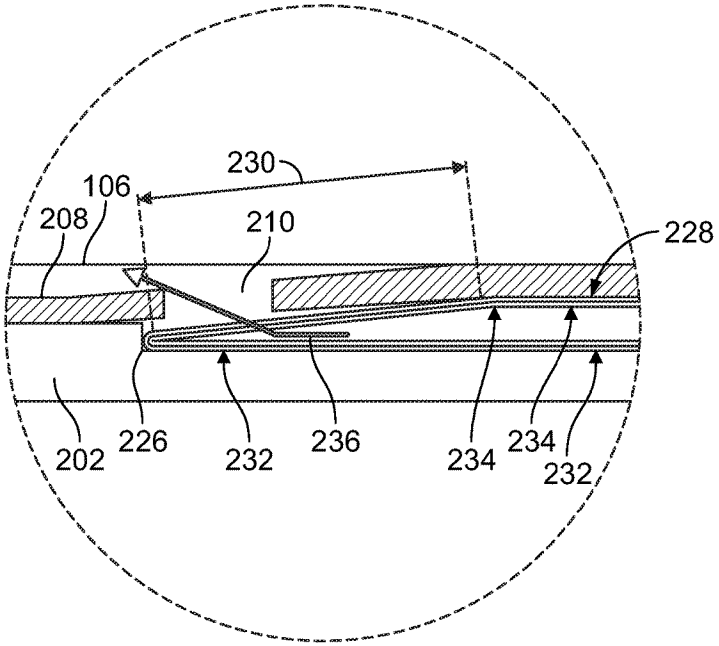
FIG. 5A and FIG. 5B illustrate a cross section of the flow diversion tool of FIG. 2 within the wellbore annulus of the wellbore casing of FIG. 1.
Figure 5A:
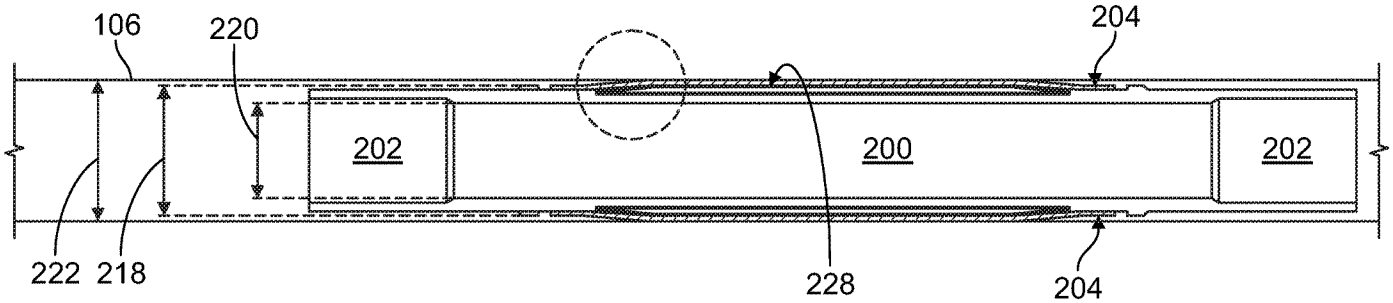
Figure 7:
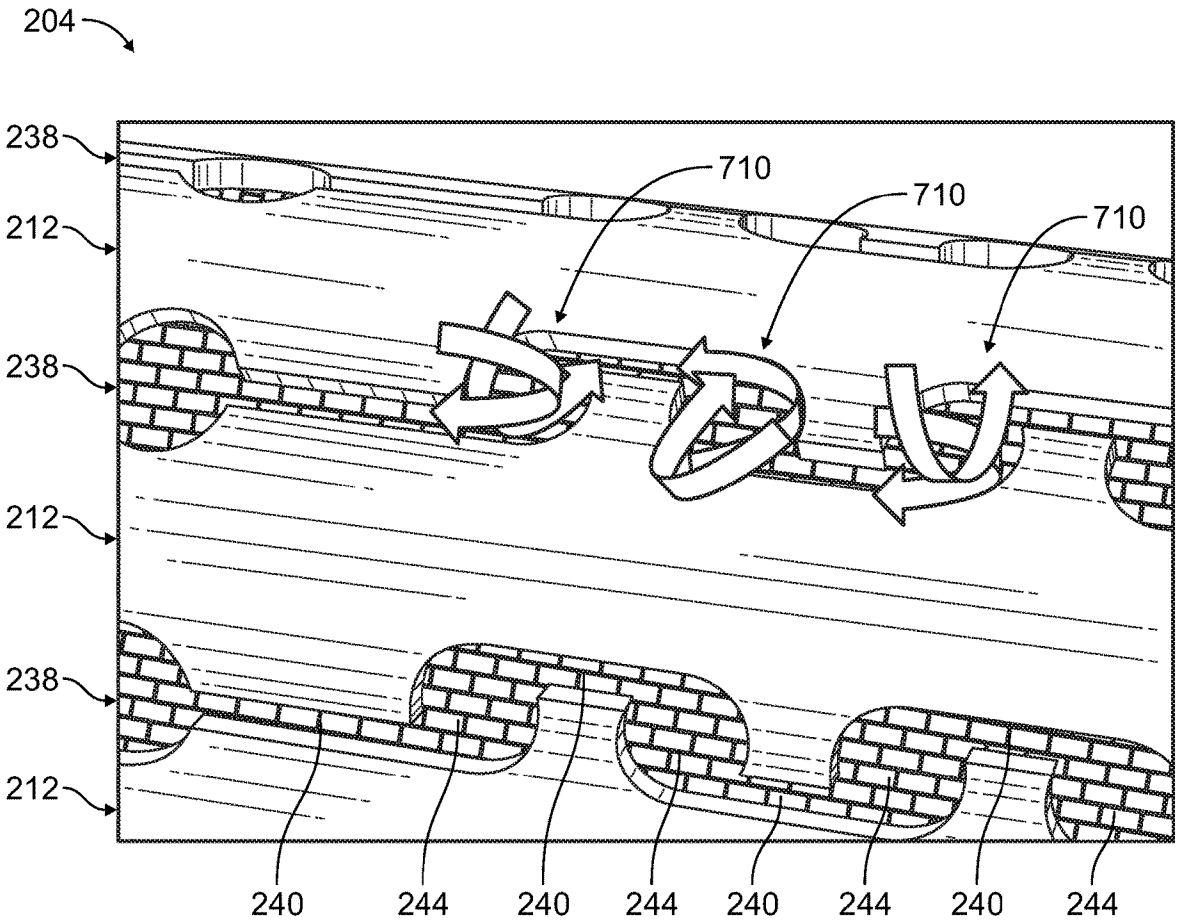
FIG. 7 illustrates tortuous path apertures through the exterior cage of the flow diversion tool of FIG. 2, according to an embodiment.

FIG. 2 illustrates a flow diversion tool 200, according to an embodiment. The wellbore flow-diversion tool 200 may be an embodiment of the wellbore flow diversion tools 112, 112', and 11 " of FIG. 1. FIG. 3A and FIG. 3B illustrate a longitudinal cross section of the flow diversion tool 200 of FIG. 2, according to an embodiment. FIG. 4 illustrates a rollout representation of the exterior cage 204 of the flow diversion tool 200 of FIG. 2, according to an embodiment. FIG. 5A and FIG. 5B illustrate a cross section of the flow diversion tool 200 of FIG. 2 within the wellbore annulus 108 of the wellbore casing 104 of FIG. 1. FIG. 7 illustrates tortuous path apertures 238 through the cage 204 of the flow diversion tool 200 of FIG. 2, according to an embodiment.

Figure 9:
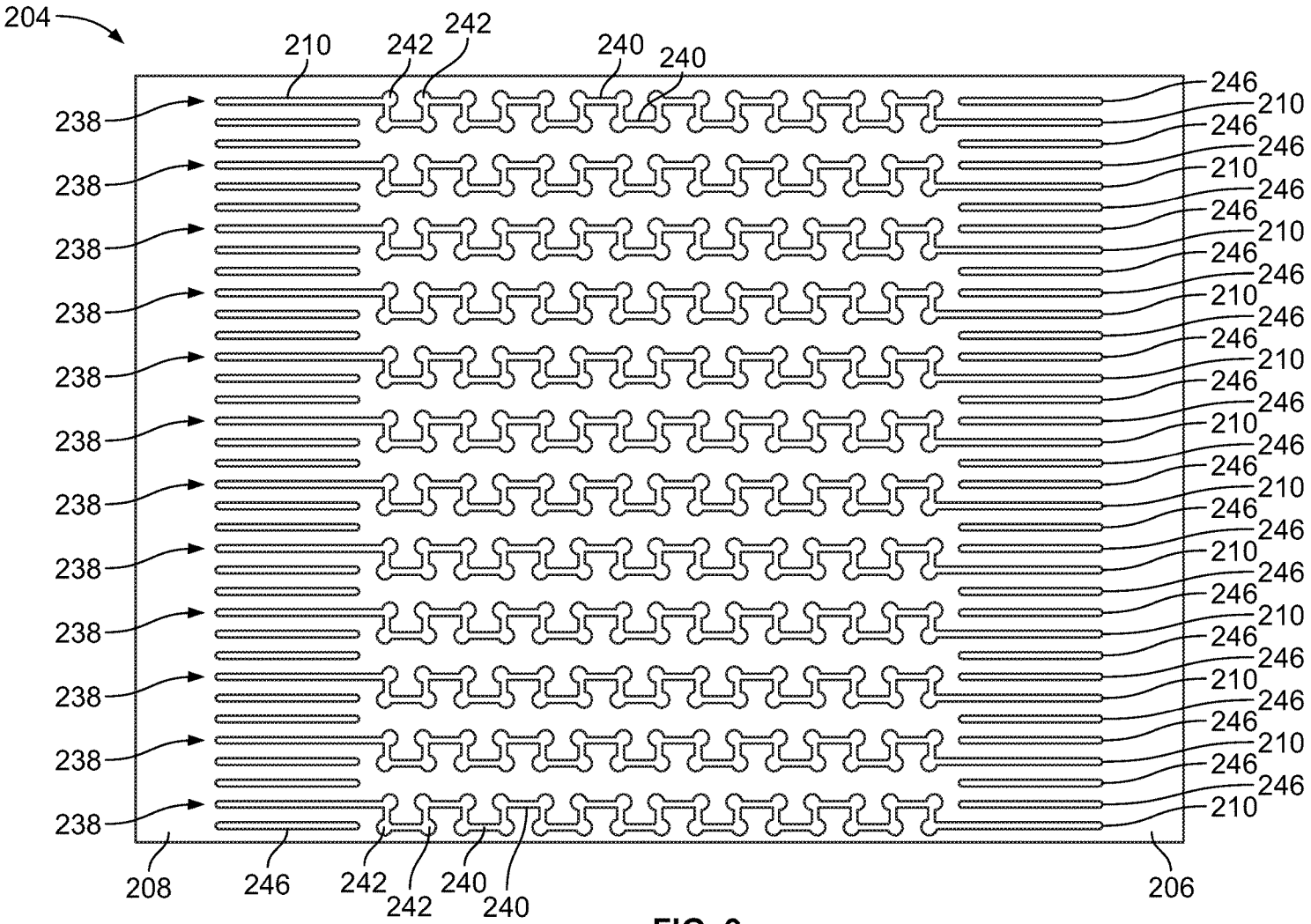
FIG. 9 illustrates a rollout representation of the exterior cage of a flow diversion tool, according to an embodiment.

It should be noted that the various features and design characteristics of the wellbore flow diversion tool shown in FIGS. 2-7, and described in detail below, are provided merely as examples, and are in no way intended to the limit the scope of the present disclosure. Instead, in one or more embodiments, one or more of the features and/or design characteristics of the wellbore flow diversion tool may differ from those shown in FIGS. 2-7. For example, in at least one embodiment, the design of the tortuous path through the cage of the flow diversion tool (e.g., through cage 204 of flow diversion tool 200 as shown in FIG. 2) may differ in one or more respects from the example tortuous path design shown in FIGS. 2, 4, 6A, 6C, and 7. For example, FIG. 9 illustrates a rollout representation of the exterior cage of the flow diversion tool, according to an embodiment, where a different design for the tortuous path is used. It should thus be understood that any or all of the tortuous path designs shown in FIGS. 2, 4, 6A, 6C, and 7 may be replaced by the tortuous path design illustrated in FIG. 9, or by some other suitable design for the tortuous path, without departing from the scope of the present disclosure.

The flow diversion tool 200 includes a mandrel pipe 202 and a cage 204 surrounding the mandrel pipe 202. The mandrel pipe 202 has a flow diversion tool total length 224 between two ends. The mandrel pipe 202 may have a variety of length values in various embodiments. In one example, the flow diversion tool total length 224 may be about 30 inches, but this should not be construed as limiting, as various other embodiments may have different flow diversion tool total lengths 224, for example about 24 inches, about 36 inches, about 48 inches, or any length therebetween. Typically, a flow diversion tool total length 224 may be less than about 120 inches. The flow diversion tool total length 224 of the mandrel pipe 202 may be determined according to a balancing of the efficiency of the flow diversion tool's 200 ability to restrict or divert fluid flow at high pressures and the ability of the flow diversion tool 200 to pass through curved regions of the wellbore casing 104 when inserting a tubing string 110 comprising a plurality of the flow diversion tools 200 into the wellbore casing 104, as well as taking into account a level of convenience in working with the flow diversion tool 200.

Each of the ends of the mandrel pipe 202 may include a pipe connector to connect with joints 114, 114' in the tubing string 110, according to an embodiment. In an embodiment, the pipe connectors of the mandrel pipe 202 may be threaded for screwing onto joints 114, 114'. In an embodiment, the pipe connectors of the mandrel pipe 202 may be flush-joint connections that provide for virtually no change in the outer diameter of the mandrel pipe 202 at the pipe connectors compared with the diameter of the joints 114, 114' where they connect to the mandrel pipe 202. The flush-joint connections combined with a downhole ring 214 and uphole ring 216 protecting the ends of the cage 204 facilitate the flow diversion tool 200 running smoothly through the wellbore casing 104 including through tight restrictions without catching on debris and becoming stuck or damaged. The sides of the downhole ring 214 and uphole ring 216 facing toward the ends of the mandrel pipe 202 may be slanted or ramped to further prevent catching on debris and becoming stuck or damaged when running through the wellbore casing 104.

In at least one embodiment, a mandrel pipe inner diameter 220 may be about 2.8 inches, and a solid outer diameter 218 of the mandrel pipe 202 may be about 3.75 inches. These dimensions should not be construed as limiting, as in various embodiments, the dimensions may be different. For example, the mandrel pipe inner diameter 220 may be about 2 inches in some embodiments, or some other value between about 2 inches and about 3 inches. The mandrel pipe inner diameter 220 may also be greater than 3 inches in other embodiments. For example, in embodiments designed for wellbore casings having a 5.5 inch outer diameter casing, an inner diameter of the mandrel pipe may be about 3.92 inches and use a chassis of a 4.5 inch outer diameter flush joint pipe. In general, the mandrel pipe inner diameter 220 may be any diameter that is sufficiently less than a diameter of the wellbore casing 104 to permit the flow diversion tool 200 to be inserted into the wellbore casing 104 and operate as described herein. Thus, where the wellbore casing 104 is larger than the embodiments described above, the dimensions of the mandrel pipe 202 would be scaled up in correspondence therewith to operate as described herein, as one of ordinary skill in the art would understand in view of the present disclosure. The mandrel pipe 202 includes an opening from one end (e.g., uphole end) to the other end (e.g., downhole end) through which fluid may flow as part of a flow of fluid through the tubing string 110. The mandrel pipe 202 may have high strength (e.g., about 110-125 ksi or 110-140 ksi minimum yield strength).

In an embodiment, the cage 204 that surrounds a center region of the mandrel pipe 202 may be fixed to the exterior of the mandrel pipe 202 at a fixed cage end 206 on the downhole side of the mandrel pipe 202. In some embodiments, the cage 204 may float between the downhole ring 214 and the uphole ring 216 without being affixed to the mandrel pipe 202. The downhole ring 214 may be integrated into the mandrel pipe 202 (e.g., constructed using a same material as an integral part of the mandrel pipe 202) on the downhole side of the mandrel pipe 202 to protect the cage 204 from being damaged by debris when the tubing string 110 including the flow diversion tool 200 is inserted into the wellbore casing 104, according to an embodiment. The flow diversion tool 200 is typically inserted into the wellbore casing 104 downhole side first in order to provide maximum protection of the cage 204. Because the downhole ring 214 is integral with the mandrel pipe 202, the downhole ring 214 has great strength to deflect debris and protect the cage 204 from being damaged when the tubing string 110 including the flow diversion tool 200 is inserted into the wellbore casing 104 compared to alternative embodiments in which a downhole ring may be constructed separately from the flow diversion tool 200 and then attached or welded onto the mandrel pipe 202. On the uphole side of the mandrel pipe 202, the uphole ring 216 may be attached or welded to the mandrel pipe 202 on an uphole side of the cage 204, in an embodiment. The uphole ring 216 is typically constructed separately from the mandrel pipe 202 and then attached or welded to the mandrel pipe 202 after the cage 204 is installed onto the mandrel pipe 202 to facilitate the cage 204 to be slid into position on the mandrel pipe 202 from the uphole side toward the downhole ring 214. In embodiments in which welding may not be desired, the uphole ring 216 may be crimped over the mandrel pipe 202 and into a shallow groove (not shown) on the mandrel pipe 202 at the location the uphole ring 216 should be attached. The uphole ring 216 protects the cage 204 from debris when the flow diversion tool 200 is pulled upward in the wellbore casing 104 along with the tubing string 110. There is typically less debris with a reduced probability of damaging the cage 204 when pulling the flow diversion tool 200 upward in the wellbore casing 104 than when pushing the flow diversion 200 downward in the wellbore casing 104.

In at least one embodiment, the cage 204 includes a sliding cage end 208 on an uphole end of the cage 204 proximate the uphole ring 216. The sliding cage end 208 may not be affixed to the mandrel pipe 202, but rather may be free to slide lengthwise along the mandrel pipe 202 to permit a plurality of bow springs 212 formed in a central region of the cage 204 to flex outward and be pressed inward when sliding against the wellbore casing inner walls 106. The plurality of the bow springs 212 milled in the cage 204 cause the cage 204 combined with the mandrel pipe 202 to function as a bow spring centralizer for the tubing string 110 when inserted into the wellbore casing 104. An outer diameter of the cage 204, defined by the outer edges of the center of the bow springs 212, may be greater than a wellbore casing inner diameter 222 of the wellbore casing 104 when the flow diversion tool 200 is outside of the wellbore casing 104, and then compress to match the wellbore casing inner diameter 222 when the flow diversion tool 200 is inserted along with the tubing string 110 into the wellbore casing 104, as illustrated in FIG. 5A and FIG. 5B. The bow springs 212 facilitate the cage 204 to also adjust to varying inner diameters of the wellbore casing 104, and permit fluid bypass around the cage 204 while running the flow diversion tool 200 into the wellbore casing 104 to reach the setting depth for a re-stimulation operation.

As an example, in an embodiment, the wellbore casing inner diameter 222 may typically be approximately 4.0 inches, while the exterior diameter of the flow diversion tool 200 including the flexible cage 204 having the bow springs 212 may have an exterior diameter outside of the wellbore casing 104 of about 4.06 to 4.07 inches. When the flow diversion tool 200 is inserted into the wellbore casing 104, the bow springs 212 may compress so that the exterior diameter of the flow diversion tool 200 matches or substantially matches the wellbore casing inner diameter 222 of about 4.0 inches.

In at least one embodiment, disposed between the cage 204 and the mandrel pipe 202 is an umbrella 228. The umbrella 228 may be secured in an umbrella notch 226 of the mandrel pipe 202. The umbrella notch 226 is a recess formed in the mandrel pipe 202 to surround the mandrel pipe 202 for most of the length of the cage 204, from about where the bow springs 212 of the cage 204 begin to rise from the surface of the mandrel pipe 202 on either end of the cage 204, according to an embodiment. The umbrella notch 226 may be, for example, approximately one eighth of an inch deep and 13.7 inches long in an embodiment. These dimensions should not be construed as limiting, as in various embodiments, the umbrella notch 226 may be deeper, shallower, longer, or shorter, according to requirements of the application and characteristics of the materials used for the umbrella 228. The dimensions of the umbrella notch 226 will typically be constrained by the thickness of the walls of the mandrel pipe 202 and the length of the cage 204 as well as the compressed thickness of folded and/or compressed material of the umbrella 228.

The umbrella 228 may be constructed of any suitable material in any suitable configuration, which will be energized by fluid passage and cause the umbrella 228 to "open" or expand inside of the cage 204, forcing the bow springs 212 of the cage 204 outward as upstream pressure increases. For example, the umbrella 228 may include a thin metallic umbrella, individual welded metal petals, or be constructed from a high strength thin fiber cloth or filament winding. In one or more embodiments, the umbrella 228 may be constructed of carbon fiber, epoxy resin tube, or spring steel rolled-up (e.g., like a newspaper) and slightly overlapped at the edges. It should be noted that in accordance with at least one embodiment, the flow diversion tool 200 may include one long umbrella 228 for uni-directional flow operation, while in another embodiment, the flow diversion tool 200 may include two umbrellas 228 (e.g., facing each other) for bi-directional flow operation.

Figure 10:
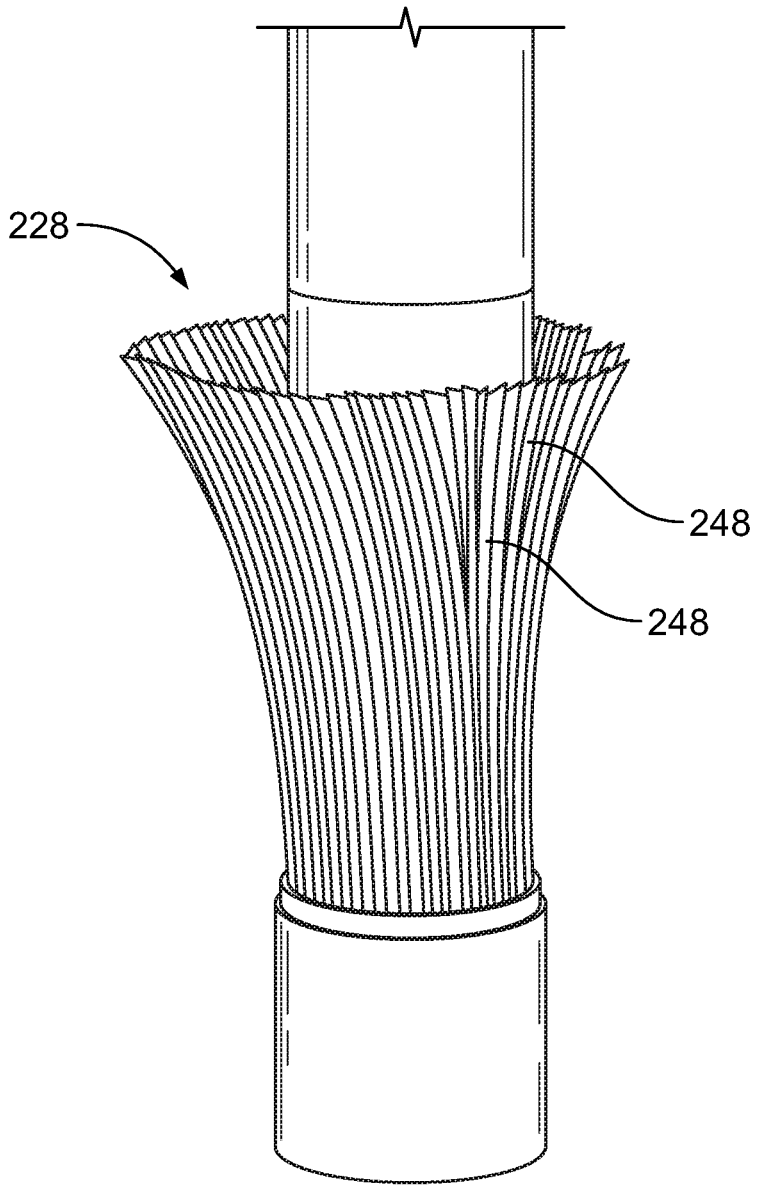
FIG. 10 illustrates an example umbrella that sits beneath the exterior cage of the flow diversion tool of FIG. 2, according to an embodiment.

FIG. 10 illustrates an example of the umbrella 228, which may surround and be attached to the exterior length of the mandrel pipe beneath the plurality of bow springs of the exterior cage 204 of the flow diversion tool 200, according to an embodiment. In the example shown, the umbrella 228 is formed as a series of overlapping stainless steel petals (e.g., slats) 248. The overlapped slats 248 of the umbrella 228 provide high strength while also allowing the umbrella 228 to work well in limited space, such as the case in some applications. In at least one embodiment, an inside surface of the umbrella 228 may be coated with an elastomeric film of rubber, silicone, or the like, to reduce leakage thru the slats 248.

In various embodiments in which the umbrella 228 is constructed from a high strength thin fiber cloth, the high strength thin fiber cloth may include a carbon fiber cloth, but in other embodiments, another material such as KEVLAR may be used. Carbon fiber is ten times stronger than steel at half the weight, and is also very thin, for example, about 0.017 inch. In addition, carbon fiber has excellent chemical and thermal properties for all types of fluids utilized in the oilfield, which elastomers do not. Due to dimensional constraints of the flow diversion tool 200 needing to have as large of an inner diameter of the mandrel pipe 202 as possible while being able to seal the wellbore casing 104 in which the flow diversion tool 200 is inserted, a thin material for the high strength thin fiber cloth may be a requirement in at least some embodiments in which the umbrella 228 is constructed of such material. Carbon fiber cloth is thin for dimensional design constraints, can be folded, and will allow fluid to migrate through it as needed. Carbon fiber is also strong enough to handle the high pressure forces encountered in frac'ing operations.

In some embodiments, the umbrella 228 may include two folded layers of high strength fiber cloth nested within one another such that there are two layers of high strength fiber cloth on a cage side of the umbrella 228 between the cage 204 and an interior of the umbrella 228, and two layers of high strength fiber cloth on a mandrel side of the umbrella 228 between the mandrel pipe 202 and the interior of the umbrella 228. The cage side of the umbrella 228 may include the umbrella ends 230 which correspond with the angled regions of the cage 204 proximate the tortuous path entrances 210, and the umbrella top 234 between the two umbrella ends 230. The mandrel side of the umbrella 228 is referred to herein as the umbrella bottom 232. The umbrella bottom 232 may be affixed to the mandrel pipe 202 within the umbrella notch 226 by an adhesive such as glue, for example, a silicone high temperature glue or an acrylic bodied glue. Glue or other types of adhesive as known in the art may be applied to the material of the umbrella 228 across the length of the umbrella bottom 232 to both stiffen the material as well as to affix the material to the mandrel pipe 202 in the umbrella notch 226. Glue (e.g., a silicone high temperature glue or an acrylic bodied glue), adhesive, epoxy, fiberglass, polyurethane resin systems, or other fluid materials that stiffen or harden when applied to fabric may be applied to the umbrella top 234 in order to stiffen the material. For example, a silicone high temperature glue may be applied to the high strength fiber cloth material, then a solvent having dissolved materials such as polycarbonate or plastic, may be run over the glued high strength fiber cloth to stiffen the fiber cloth. As the solvent evaporates, a stiffening material such as polycarbonate or plastic is left behind in the fiber cloth. If the material is not stiffened, it may fail in a pressure differential and turn itself inside out if it were not contained within the high strength cage 204. In some embodiments, the umbrella ends 230 may not be stiffened with the material used to stiffen the umbrella top 234 in order to permit fluid to flow through the layers of the umbrella ends 230 below the tortuous path entrances 210. In other embodiments, both the umbrella ends 230 and the umbrella top 234 may be stiffened to help the umbrella 228 maintain its shape in high pressure and high flow rate environments.

When the flow diversion tool 200 is inserted in the wellbore casing 104, relatively low pressure fluid may flow through a plurality of tortuous path entrances 210 into a space between the cage 204 and the exterior of the mandrel pipe 202. When the fluid is at a sufficiently low pressure and/or flowing at a sufficiently low speed or fluid flow rate, e.g., below a free-flow threshold, the fluid may freely flow through the space between the cage 204 and the exterior of the mandrel pipe 202 and/or through a plurality of tortuous path apertures 238 (see FIGS. 4, 7, and 9) between corresponding tortuous path entrances 210 on each end of the cage 204. At this sufficiently low pressure and/or fluid flow rate, the umbrella 228 may not be inflated with the umbrella top 228 pressed against the cage 204 as shown in FIG. 3A and FIG. 3B, but rather be deflated and leave space for fluid to flow between the umbrella top 234 and an interior side of the cage 204 from one end of the cage 204 to the other. When the pressure and/or flow rate of the fluid increases beyond a threshold, e.g., a substantially-blocking threshold, the umbrella 228 begins to open or inflate, pressing the umbrella top 234 against the interior side of the cage 204 and the tortuous path apertures 238, and blocking fluid flow through the space between the cage 204 and the exterior of the mandrel pipe 202. The opening of the umbrella 228 may also further press the bow springs 212 of the cage 204 against the wellbore casing inner wall 106. Fluid pressures associated with the free-flow threshold may be significantly lower than those associated with the substantially-blocking threshold. Specific values of the free-flow threshold and the substantially-blocking threshold depend on many factors, including specific design parameters for the embodiments and physical characteristics of the fluid. Tortuous paths in general are well known to create pressure build-up, and therefore resistance to fluid flow.

Also, in some embodiments, fluid can enter the cage 204 through a tortuous path entrance 210 on a high pressure side of the cage 204, where fluid is at a high pressure in comparison with fluid on an opposite side of the cage 204 (e.g., uphole vs. downhole), and collapse the umbrella 228. Then, fluid can re-enter the interior of the umbrella 228 through circular path openings 244 as ports at the center region of the cage 204 and help to inflate the umbrella 228 on the low pressure side of the cage 204. When the umbrella 228 is stiffened as described above, the umbrella 228 may be rigidly pressed against the inner diameter of the cage 204, and the umbrella 228 may not inflate until fluid pressures are elevated.

When the umbrella ends 230 are porous and not stiffened, fluid may flow through an optional fluid flow path 236 through the umbrella ends 230 and the tortuous path entrances 210, according to an embodiment. Fluid flow through the optional fluid flow path 236 may assist in keeping the umbrella 228 inflated and blocking a much larger fluid flow that would otherwise pass between the umbrella top 234 and the cage 204. Thus, the amount of fluid flowing through the optional fluid flow path 236 may be a small fraction of the fluid that would flow through the space between the cage 204 and the exterior of the mandrel pipe 202 when the umbrella 228 is not inflated. Fluid flow through the optional fluid flow path 236 through the porous high strength fiber cloth of the umbrella ends 230 creates a pressure drop combining with confused fluid flow along the tortuous path apertures 238 of the cage 204 on the outside contact area of the cage 204 with the parent wellbore casing inner wall 106, resulting in a greatly reduced annular flow past the flow diversion tool 200, effectively creating an adequate seal between the wellbore casing 104 and the tubing string 110 in which the flow diversion tool 200 is installed. In addition, the high strength fiber cloth of the umbrella ends 230 blocks sand mixed in the fluid, and the sand helps to cause the umbrella 228 to seal the wellbore annulus 108 where the flow diversion tool 200 is installed.

The number of layers of material of which the umbrella 228 is constructed should not be construed as being limited to the number described above and illustrated herein. In various embodiments, fewer or more layers of material may be used, based on such factors as total material thickness that will fit within the umbrella notch 226, strength of the material, amount of fluid flow permitted through the material, amount of fluid pressure and/or flow required to deploy the umbrella 228 for each number of layers of material, and ability to freely flow fluid through the cage 204 at low pressures and/or flow rates at different numbers of layers of material.

As illustrated in FIG. 4 to show how the cage 204 would appear if cut open lengthwise and rolled out flat, the cage 204 includes a plurality of tortuous path apertures 238 cut lengthwise from a sliding cage end 208 (uphole end) to a fixed cage end 206 (downhole end), in accordance with an embodiment. In between the tortuous path apertures 238 are formed a plurality of bow springs 212. The tortuous path apertures 238 are shown as a series of ovals (tortuous path entrances 210) and circles (small circular path openings 242 and large circular path openings 244) connected by narrow straight paths 240. The tortuous path entrances 210 are disposed in the regions of the cage 204 that transition from a fixed solid outer diameter 218 equal to or slightly smaller than an outer diameter of the downhole ring 214 and uphole ring 216, to an expandable and collapsible outer diameter of the bow springs 212 that press against the wellbore casing inner wall 106. In an embodiment, the straight paths 240 may have a width of about 0.2 inch, the small circular path openings 242 may have a diameter of about ⅝ inch, the large circular path openings 244 may have a diameter of about ¾ inch, and the tortuous path entrances 210 may be about 1¾ inch by ¾ inch oval shaped openings. There may be a total of 8 tortuous path apertures 238 disposed around the cage 204 at a spacing of about 45 degrees from one another. In various embodiments, there may be more or fewer tortuous path apertures 238 and bow springs 212 distributed around the cage 204, and they may be spaced apart from one another at different intervals than illustrated. The specific shape shown in FIG. 4 and the dimensions discussed in relationship thereto should not be construed as limiting, as in various embodiments, the tortuous path apertures may take on other sizes, shapes and forms, including shapes such as zig-zags, Z-shapes, zipper shapes, sawtooth shapes, diagonals, and other combinations of circular, oval, curved, and straight path segments that cause fluid flow to change directions and be confused.

A tortuous path is one having many twists, bends, or turns which confuse fluid flow through the tortuous path, which creates resistance resulting in pressure drops and minimal leakage from one end of the cage 204 to the other. The tortuous path apertures 238 cause fluid to have eddies and/or swirls 710 (see FIG. 7) in the circles, thereby confusing the fluid flow. In fact, in the embodiment as shown, the fluid coursing through the tortuous path apertures 238 must change directions several times through the tortuous path aperture 238 from one end of the cage 204 to the other. In some embodiments, the tortuous path apertures 238 alone may restrict fluid flow through the wellbore annulus 108 essentially completely or sufficiently for practical purposes such that the umbrella 228 is unnecessary and therefore not included in the flow diversion tool of these embodiments.

FIG. 9 illustrates how the cage 204 of the flow diversion tool would appear if cut open lengthwise and rolled out flat, in accordance with another embodiment. It should be noted that one or more of the example features of the rollout representation of the exterior cage 204 shown in FIG. 9 may be similar to one or more of the corresponding features of the example rollout representation of the exterior cage 204 shown in FIG. 4, and described in detail above, in one or more embodiments. It should also be noted that, for purposes of brevity, one or more of the example features of the rollout representation of the exterior cage 204 shown in FIG. 4 may not be shown in the example rollout representation of the exterior cage 204 shown in FIG. 9. For example, although not illustrated in FIG. 9, the example rollout representation of the exterior cage 204 may nonetheless include a plurality of bow springs 212 between the tortuous path apertures 238.

With reference to the example rollout representation of FIG. 9, the cage 204 may include a plurality of tortuous path apertures 238 cut lengthwise from a sliding cage end 208 (e.g., uphole end) to a fixed cage end 206 (e.g., downhole end), in accordance with an embodiment. In between the tortuous path apertures 238 there may be formed a plurality of bow springs (not shown). The tortuous path apertures 238 are shown as a series of extended ovals (tortuous path entrances 210) and circles 242, where the circles are connected by narrow straight paths 240. The tortuous path entrances 210 are disposed in the regions of the cage 204 that transition from a fixed solid outer diameter 218 equal to or slightly smaller than an outer diameter of the downhole ring 214 and uphole ring 216, to an expandable and collapsible outer diameter of the bow springs that press against the wellbore casing inner wall 106. In at least one embodiment, there may be a total of 12 tortuous path apertures 238 disposed around the cage 204 at an equal or substantially equal spacing from one another. In various embodiments, there may be more or fewer tortuous path apertures 238 distributed around the cage 204, and they may be spaced apart from one another at different intervals than illustrated.

With reference again to the example rollout representation of the exterior cage 204 shown in FIG. 9, the cage 204 may also include a plurality of grooves 246 at each end of the cage 204, in an embodiment. The grooves 246 are designed to allow the bow springs to collapse and expand with less force, thereby giving the cage 204 ample flexibility so that it can compress easily enough to go through tight restrictions. It should be noted that the grooves 246 at each end of the cage 204 may not be configured to allow flow unless, for example, a porous cloth material is used.

In one or more embodiments, the tortuous path through the cage of the flow diversion tool (e.g., through cage 204 of flow diversion tool 200, shown in FIG. 2) may be designed such that the series of circular path openings 242 connected by narrow straight paths 240 (e.g., that together comprise the tortuous path apertures 238) may constitute "blind tees" (e.g., may be locations where a "blind tee" effect occurs, which are areas of severe turbulence), which provide a fluid cushion for fluid and abrasives making a 90-degree turn. Without the stagnant fluid cushion the erosive fluid will quickly erode the tee where it is making the turn. For example, in an embodiment, the circular path openings 242 in the outside of the cage 204 provide a swirling pattern, which act as blind tees.

Figure 11:
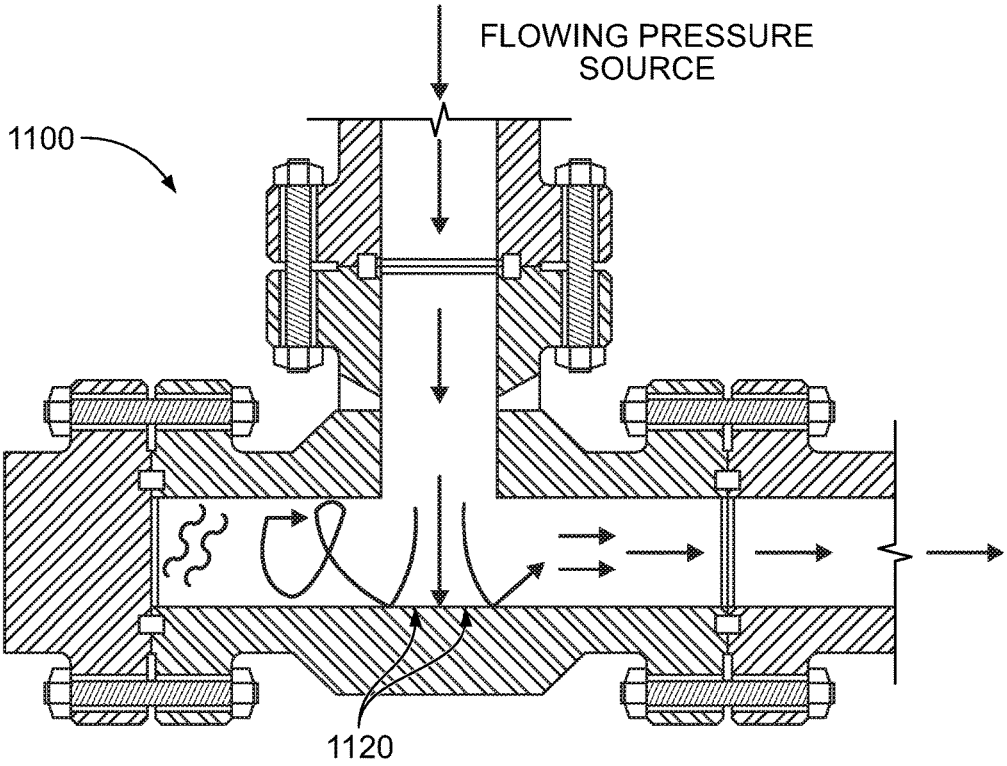
FIG. 11 illustrates an example arrangement of a blind tee, according to an embodiment.
Figure 12:
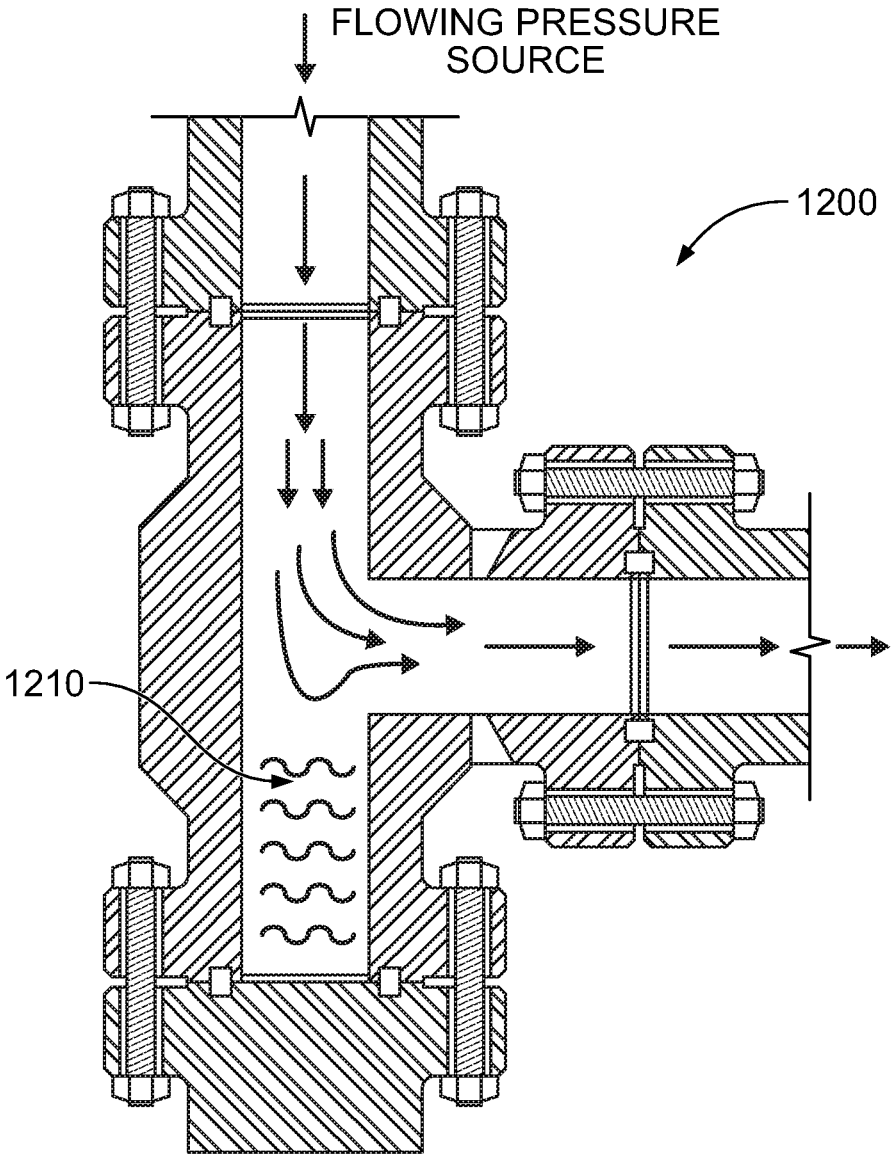
FIG. 12 illustrates an example arrangement of a blind tee, according to an embodiment.
Figure 13:
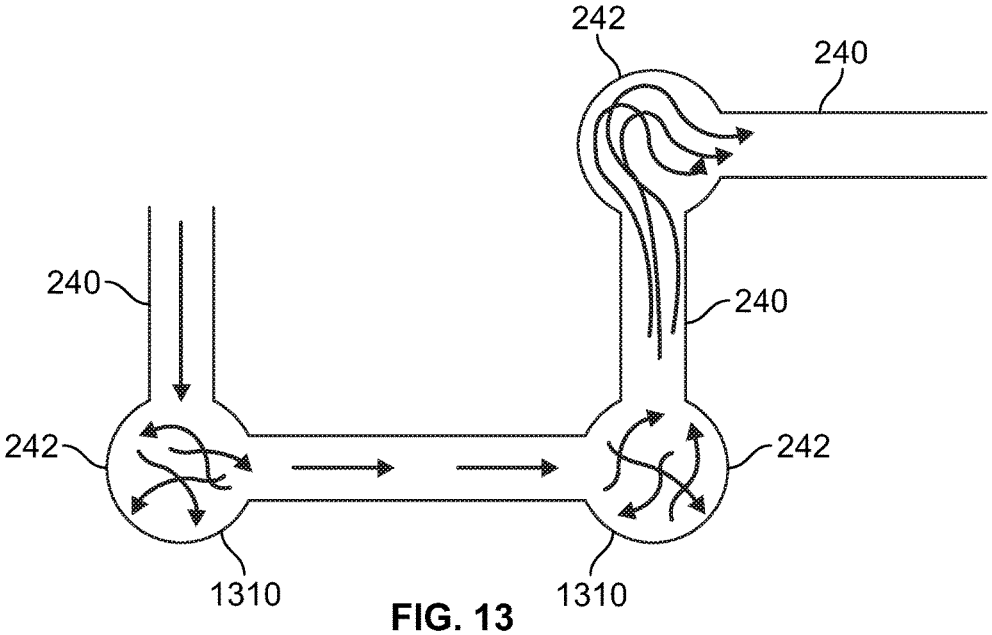
FIG. 13 illustrates example fluid confusion areas created by blind tee arrangements, according to an embodiment.

FIGS. 11 and 12 illustrate example orientations of blind tees, in accordance with one or more embodiments. For example, the orientation of the tee 1100 shown in FIG. 11 may have an area of potential erosion 1120 from the flow of the erosive fluid (e.g., sand-laden fluid). On the other hand, the orientation of the tee 1200 shown in FIG. 12 creates a fluid cushion 1210 beyond the 90-degree turn (e.g., a fluid "shock absorber"), so that the fluid tends to protect the body from erosion. In at least some embodiments, the circular path openings 242 in the outside of the cage 204 may be formed such that they are similar to the tee orientation 1200 shown in FIG. 12. For example, FIG. 13 illustrates fluid confusion areas 1310 created by the blind tee arrangements formed of the circular path openings 242 in the outside of the cage 204, according to an embodiment.

In at least one embodiment, the cage 204 may be constructed of an electroless nickel plated steel or low alloy carbon steel for strength, low friction, and resistance to corrosion and erosion from the frac sand being pumped in fracturing operations. The cage 204 may have a yield strength of, for example, 80,000 ksi minimum. In an embodiment, the steel used to construct the cage 204 may have 18-22 Rockwell C hardness. In another embodiment, the cage 204 may also be constructed of a nickel alloy, such as 718, 825, or 925 nickel alloy. In other embodiments, the cage 204 may be constructed of 13-Chrome stainless steel. In an embodiment, the cage 204 may have walls about 0.24 inches thick. A total length of the cage 204 from the fixed cage end 206 to the sliding cage end 208 may be about 16.3 inches, in an embodiment. An inner diameter of the cage 204 at each of the ends may be about 3.5 inches, while an outer diameter of the cage 204 at each of the ends may be about 3.75 inches, in at least one embodiment. In some embodiments, an inner diameter of the cage 204 at a center of the bow springs 212 may be about 3.75 inches, while an outer diameter of the cage 204 at the center of the bow springs 212 may be about 4.07 inches. In the region of the tortuous path entrances 210, the cage may angle outward from the mandrel pipe 202 at an angle of about 4 degrees for a distance of about 2 inches starting from about 1 inch from each end of the cage, in accordance with one or more embodiments. Due to the flexibility of the bow springs 212 and the freedom of movement of the sliding cage end 208 along the mandrel pipe 202, the cage 204 may collapse to a maximum outer diameter of about 3.75 inches, according to an embodiment.

In an embodiment, a length of the mandrel pipe 202 may be approximately 30.3 inches from end to end, and the outer diameter of the pipe at the ends of the mandrel pipe 202 may be about 3.5 inches. The downhole ring 214 may be formed about 4 inches from the downhole end of the mandrel pipe 202, and have an outer diameter of about 3.75 inches. The umbrella notch 226 may have a depth of about ⅛ inch and range from about 6.2 inches to about 19.9 inches from the downhole end of the mandrel pipe 202. One end of the mandrel pipe 202 may have a female threaded interior to attach to male threaded tubing, while the other end of the mandrel pipe 202 may have a male threaded exterior to attach to female threaded tubing. Typically, the mandrel pipe 202 may be male threaded on a downhole side and female threaded on an uphole side. An inner diameter of each end of the mandrel pipe 202 may be approximately 2.938 inches, and an inner diameter of the mandrel pipe 202 between the threaded end regions of the mandrel pipe 202 may be about 2.75 inches. The mandrel pipe 202 may be connected with long standard length sections of tubing in the tubing string 110 having the same thread form as the mandrel pipe 202. The thread form of the mandrel pipe 202 is universal to virtually every accessory tool for wellbores in the industry for purposes of compatibility, but the mandrel pipe 202 has unique shapes and dimensions for achieving its unique flow diversion capabilities described herein.

In another embodiment, a length of the mandrel pipe 202 may be approximately 23.9 inches from end to end, and the outer diameter of the pipe at the ends of the mandrel pipe 202 may be about 3.5 inches. The downhole ring 214 may be formed about 4 inches from the downhole end of the mandrel pipe 202, and have an outer diameter of about 3.75 inches. The umbrella notch 226 may have a depth of about ⅛ inch and range from about 6.2 inches to about 19.9 inches from the downhole end of the mandrel pipe 202. Each end of the mandrel pipe 202 may be female threaded to attach to male threaded tubing or be male threaded to attach to female threaded tubing. An inner diameter of each end of the mandrel pipe 202 may be approximately 2.938 inches, and an inner diameter of the mandrel pipe 202 between the threaded end regions of the mandrel pipe 202 may be about 2.4 inches. In various embodiments, the threading of the mandrel pipe 202 may extend the overall length of the mandrel pipe 202 by about a foot on either side of the mandrel pipe 202 shown in the drawings. Due to variations in dimensions of third party pipe threads to be attached to the mandrel pipe 202, the type and size of the threading and dimensions and length of the mandrel pipe 202 may also vary for compatibility purposes.

In general, dimensions of the flow diversion tool 200 and its constituent components may be varied according to the application. For example, the mandrel pipe 202 and cage 204 may be constructed to have larger diameters when desired to be used in wellbore casings 104 having larger diameters than the wellbore casing 104 dimensions of about 4.5 inches discussed above.

Figure 6E:
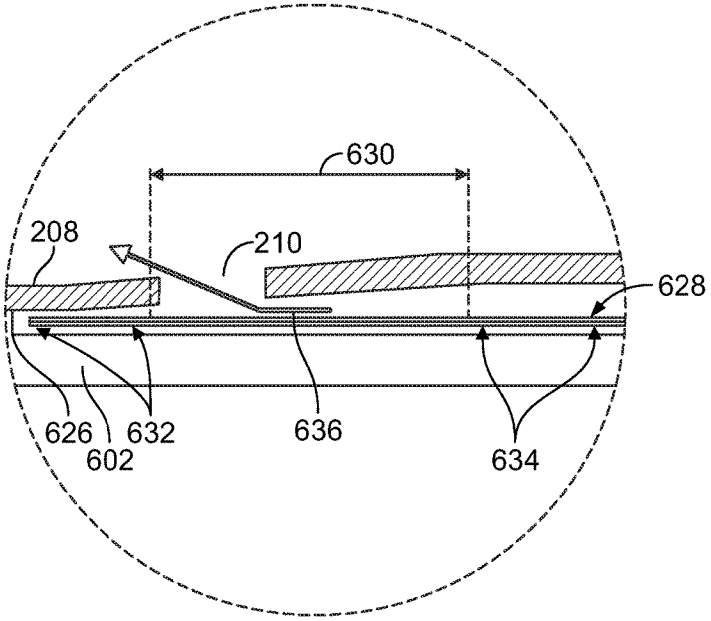
FIG. 6C and FIG. 6E illustrate a three quarter section view of the flow diversion tool of FIG. 6A in a free-flow mode, according to an embodiment.
Figure 6C:
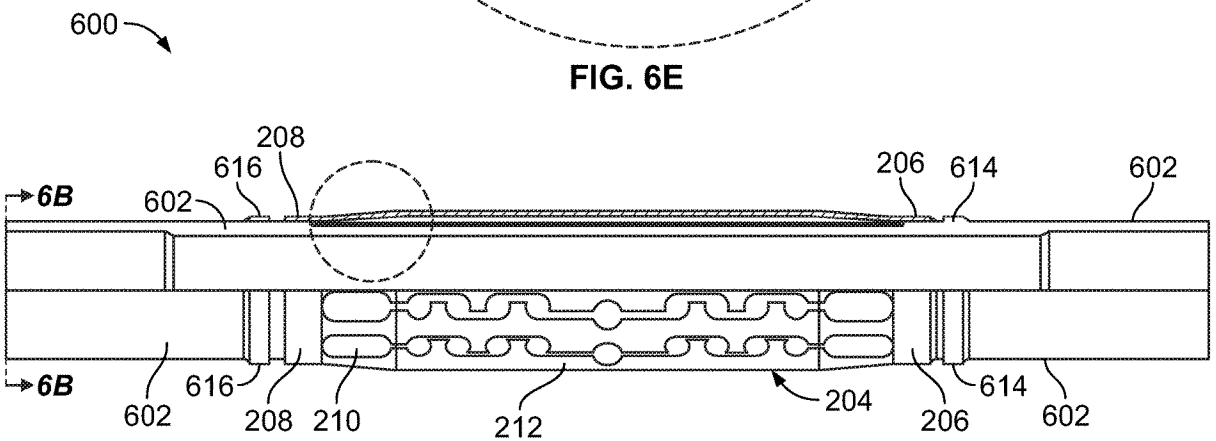

FIG. 6A illustrates a three quarter section view of a flow diversion tool 600 in a substantially-blocking mode, according to another embodiment. FIG. 6B illustrates an end view of the flow diversion tool of FIG. 6A and FIG. 6C, according to an embodiment. FIG. 6C illustrates a three quarter section view of the flow diversion tool of FIG. 6A in a free-flow mode, according to an embodiment.

The flow diversion tool 600 is similar in many respects to the flow diversion tool 200 of FIG. 2, discussed above, with some differences as described below. The flow diversion tool 600 includes an umbrella 628 that differs from the umbrella 228 in design and construction. The umbrella 628 includes two layers of high strength thin fiber cloth or filament winding, that are affixed to a bottom of an umbrella notch 626 at fixed umbrella ends 632 on each end of the umbrella notch 626, and not affixed to the bottom of the umbrella notch 626 in between. In various embodiments, the high strength thin fiber cloth may include carbon fiber cloth, but in other embodiments, another high strength material such as KEVLAR or a KEVLAR-fiber hybrid may be used. In still other embodiments, small slats of steel may be spot welded onto the high strength fiber cloth. An advantage that carbon fiber cloth has over KEVLAR is that carbon fiber cloth is resistant to hydrochloric acid. The key requirements for the high strength fiber cloth is that it is thin to facilitate compression within the cage 204 to allow fluid flow through the cage 204, it is strong to withstand high pressure/flow rates, and that it be able to bypass and filter fluid. The ends of the umbrella notch 626 at which the fixed umbrella ends 632 are affixed to the bottom of the umbrella notch 626 may be below at least a portion of the sliding cage end 208 and fixed cage end 206 of the cage 204. The fixed umbrella ends 632 may be affixed to the bottom of the umbrella notch 626 using glue or another adhesive as known in the art. Adjacent to each fixed umbrella end 632 is a deployable umbrella end 630 that corresponds to the umbrella end 230 and is disposed below the cage 204 in the region below the plurality of tortuous path entrances 210. Glue, adhesive, epoxy, fiberglass, polyurethane resin systems, or other fluid materials that stiffen or harden when applied to fabric may be applied to the central umbrella region 634 in order to stiffen the material. In some embodiments, the deployable umbrella ends 630 may not be stiffened with the material used to stiffen the central umbrella region 634 in order to permit fluid to flow through the layers of the deployable umbrella ends 630 below the tortuous path entrance 210. In other embodiments, both the deployable umbrella ends 630 and the central umbrella region 634 may be stiffened to help the umbrella 628 maintain its shape.

A length and/or depth of the umbrella notch 626 may be different than that of the umbrella notch 226 because of the differences in design and construction of the umbrella 628 compared to the umbrella 228. For example, the umbrella notch 626 may extend further toward the uphole ring 616 and the downhole ring 614 than the umbrella notch 226 extends toward the uphole ring 216 and the downhole ring 214. In addition, since there are fewer layers of material in the umbrella 628 compared to the umbrella 228, the umbrella notch 626 may be shallower than the umbrella notch 226.

When the flow diversion tool 600 is inserted in the wellbore casing 104, relatively low pressure fluid may flow through a plurality of tortuous path entrances 210 into a space between the cage 204 and the exterior of the mandrel pipe 602. When the fluid is at a sufficiently low pressure and/or flowing at a sufficiently low speed or fluid flow rate, e.g., below a free-flow threshold, the fluid may freely flow through the space between the cage 204 and the exterior of the mandrel pipe 602 and/or through a plurality of tortuous path apertures 238 (see FIGS. 4 and 7) between corresponding tortuous path entrances 210 on each end of the cage 204. At this sufficiently low pressure and/or fluid flow rate, the umbrella 628 may not be inflated with the central umbrella region 634 pressed against the cage 204 as shown in FIG. 6A, but rather be deflated and leave space for fluid to flow between the central umbrella region 634 and an interior side of the cage 204 from one end of the cage 204 to the other as shown in FIG. 6C. When the pressure and/or flow rate of the fluid increases beyond a threshold, e.g., the free-flow threshold, the umbrella 628 may begin to open or inflate, and above a substantially-blocking threshold, may press the central umbrella region 634 against the interior side of the cage 204, and adequately block fluid flow through the space between the cage 204 and the exterior of the mandrel pipe 602. The opening of the umbrella 628 may also further press the bow springs 212 of the cage 204 against the wellbore casing inner wall 106. When the deployable umbrella ends 630 are porous and not stiffened, fluid may flow through an optional fluid flow path 636 through the deployable umbrella ends 630 and the tortuous path entrances 210. Fluid flow through the optional fluid flow path 636 may assist in keeping the umbrella 628 inflated and blocking a much larger fluid flow that would otherwise pass through the cage 204. Thus, the amount of fluid flowing through the optional fluid flow path 636 may be a small fraction of the fluid that would otherwise flow through the space between the cage 204 and the exterior of the mandrel pipe 602 when the umbrella 628 is not inflated.

In some embodiments, if the umbrella 228 is stiffened with a harder matrix, such as epoxy, the umbrella 228 may be pre-energized, or formed, against the inner diameter of the cage 204. In these embodiments, an increase in pressure would further energize and expand the umbrella 228 and cage 204.

The downhole ring 614 and the uphole ring 616 correspond to the downhole ring 214 and the uphole ring 216 of the flow diversion tool 200, with possible differences in their locations along the length of the flow diversion tool 600 compared to the length of the flow diversion tool 200 due to differences in the design and construction of the umbrella 628 compared to the umbrella 228.

The number of layers of material of which the umbrella 628 is constructed should not be construed as being limited to the number described above and illustrated herein. In various embodiments, fewer or more layers of material may be used, based on such factors as total material thickness that will fit within the umbrella notch 626, strength of the material, amount of fluid flow permitted through the material, the amount of fluid pressure and/or flow required to deploy the umbrella 628 for each number of layers of material, and ability to freely flow fluid through the cage 204 at low pressures and/or flow rates at different numbers of layers of material. Also, as previously described with reference to FIGS. 2-5, the shape and materials of the umbrella 628 may be separated for collapsibility, and the umbrella 628 may be constructed of thin metallic material or individual welded metal petals as well as of a fiber cloth material.

Figure 8:
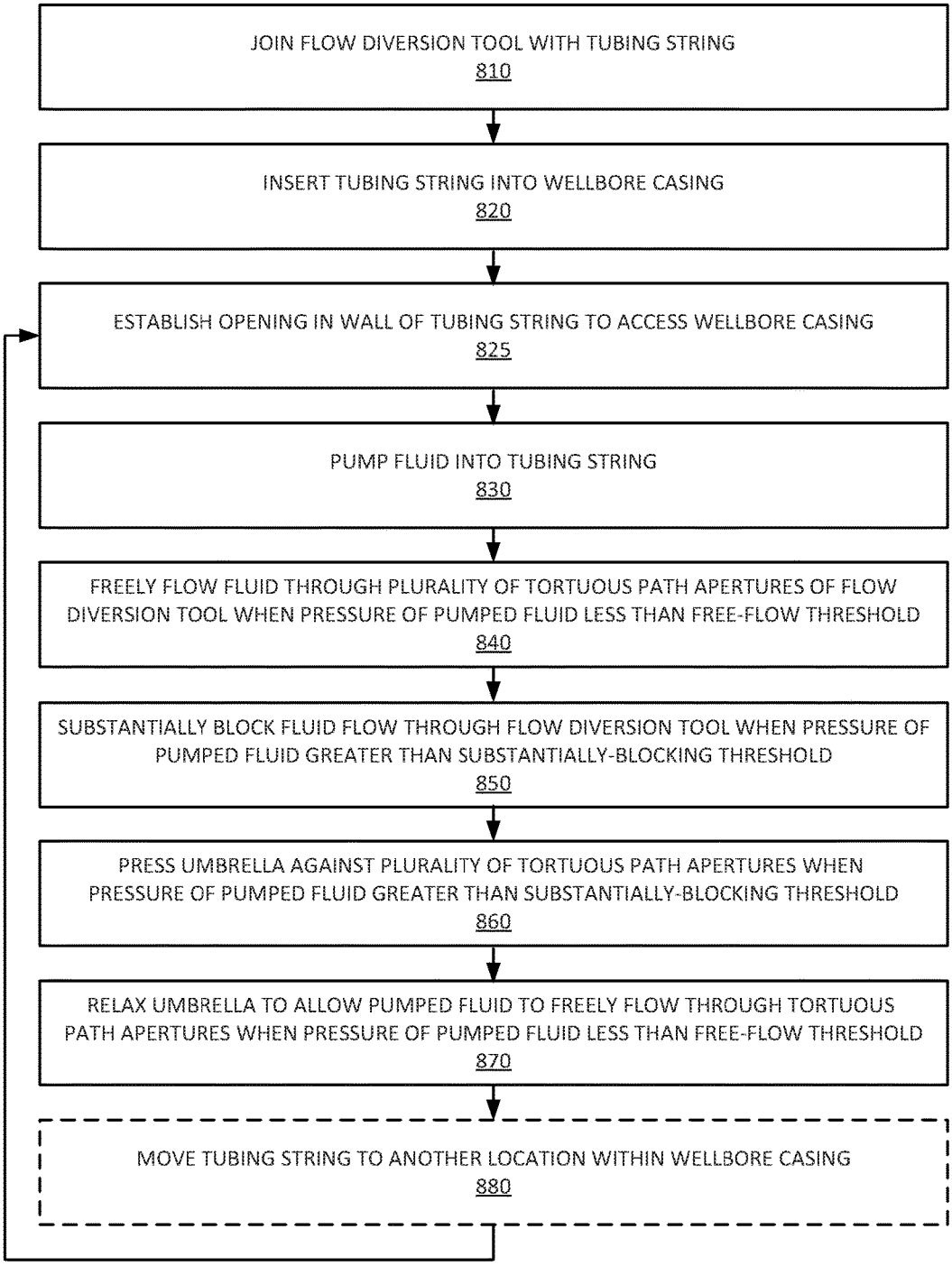
FIG. 8 illustrates a method of re-stimulating a well using a flow diversion tool, according to an embodiment.

FIG. 8 illustrates a method of re-stimulating a well using a flow diversion tool 200 or 600, according to an embodiment.

At block 810, a flow diversion tool 200 or 600 is joined with a tubing string 110. In an embodiment, the tubing string 110 may be joined with a plurality of flow diversion tools 200 or 600 at predefined distances therebetween. The flow diversion tool 200 or 600 may include a hollow mandrel pipe 202 having two open ends adapted to attach to the tubing string. The flow diversion tool 200 or 600 may also include a cylindrical cage 204 surrounding and attached to an exterior length of the mandrel pipe 202, the cylindrical cage 204 having a plurality of generally lengthwise tortuous path apertures 238 generally parallel with one another between the two open ends of the mandrel pipe 202. The plurality of generally lengthwise tortuous path apertures 238 may define a plurality of bow springs 212 therebetween, each of which bow outward from the mandrel pipe 202.

At block 820, the tubing string 110 joined with the flow diversion tool 200 or 600 is inserted into a wellbore casing 104. The tubing string 110 may be inserted until an end of the tubing string 110 is proximate a region of the wellbore casing 104 where a frac'ing operation is desired to be performed (whether a horizontal region or a vertical region of the wellbore casing 104), proximate a toe end of the wellbore casing 104, or until the flow diversion tool 200 or 600 is within the horizontal length of the wellbore casing 104 in a formation to be stimulated.

At block 825, one or more openings in the wall of the tubing string 110 are established to access the wellbore casing 104. These openings may be established by perforating the wall of the tubing string 110 using a perforating tool or other mechanism as known in the art, or by using a valve tool attached to the tubing string 110 that includes sleeves that may be moved from a closed position to an open position to provide access to the wellbore casing 104 through openings in the side of the valve tool. In an embodiment, the sleeves may open when fluid pressure within the valve tool exceeds a rupture threshold at which rupture disks rupture and permit fluid to flow into a chamber in the wall of the valve tool that causes the sleeve to slide into an open position, facilitating fluid to flow from inside the valve tool to the wellbore annulus 108 and the wellbore casing 104.

At block 830, the fluid is pumped into the tubing string 110. The fluid may include a solvent, sand, and/or other fluids or gels as known in the art for performing frac'ing operations. The fluid may also include a fluid for treatment of the borehole 102, which may be performed in conjunction with frac'ing operations. The fluid may be pumped at a low pressure and/or flow rate at one time, for example, when the tubing string 110 is being inserted into the wellbore casing 104, and at a high pressure and/or flow rate at another time, for example, when a region of the well proximate the flow diversion tool 200 or 600 is being stimulated. The fluid may exit the tubing string 110 and flow into the wellbore annulus 108 through holes (perforations) in the tubing string 110, or via open ball frac sleeves in the tubing string 110.

At block 840, the pumped fluid is freely flowed through the plurality of tortuous path apertures 238 of the flow diversion tool 200 or 600 when the pressure of the pumped fluid is less than a free-flow threshold.

At block 850, flow of the pumped fluid is substantially blocked through the flow diversion tool 200 or 600 when the pressure of the pumped fluid is greater than a substantially-blocking threshold. The substantially-blocking threshold may be larger than the free-flow threshold, as the transition between free flow of the pumped fluid through the flow diversion tool 200 or 600 and substantially blocking the flow through the flow diversion tool 200 or 600 may be gradual as the fluid flow through the tortuous path apertures 238 becomes confused causing a reduction in pressure.

In some embodiments, the flow diversion tool 200 or 600 further includes an umbrella 228 surrounding and attached to the exterior length of the mandrel pipe 202 beneath the plurality of bow springs 212 of the cylindrical cage 204. The umbrella 228 may be structurally configured to expand outward toward the plurality of bow springs 212 when a fluid flows through the plurality of generally lengthwise tortuous path apertures 238 adjacent the umbrella 228 at a pressure between the free-flow threshold and the substantially-blocking threshold, and remain expanded outward when the pressure is above the substantially-blocking threshold. As described above, the umbrella 228 may be constructed of any suitable material in any suitable configuration, which will be energized by fluid passage and cause the umbrella 228 to "open" or expand inside of the cage 204, forcing the bow springs 212 of the cage 204 outward as upstream pressure increases. For example, in one or more embodiments, the umbrella 228 may include a thin metallic umbrella, individual welded metal petals, or be constructed from a high strength thin fiber cloth or filament winding. In some embodiments, the umbrella 228 may be constructed of carbon fiber, epoxy resin tube, or spring steel rolled-up (e.g., like a newspaper) and slightly overlapped at the edges.

At block 860, the umbrella 228 is pressed against the plurality of tortuous path apertures 238 to block fluid flow through the plurality of tortuous path apertures 238 when the pressure of the pumped fluid is greater than the substantially-blocking threshold. The umbrella 228 may also be pressed against the plurality of bow springs 212 when the pressure of the pumped fluid is greater than the substantially-blocking threshold.

At block 870, the umbrella is relaxed to allow the pumped fluid to flow freely through the plurality of tortuous path apertures 238 when the pressure of the pumped fluid is less than the free-flow threshold.

In at least one embodiment, the method of re-stimulating a well using a flow diversion tool 200 or 600 may include the operations of optional block 880. At optional block 880, the tubing string 110 joined with the flow diversion tool 200 or 600 is moved to another location within the wellbore casing 104. Fluid may be pumped into the wellbore annulus 108 between the tubing string 110 and the wellbore casing 104 at a low pressure, e.g., below the free-flow threshold, while the flow diversion tool 200 or 600 is moved. Alternatively, if the tubing string 110 includes numerous flow diversion tools 200 or 600, the tubing string 110 may remain stationary but the process can continue from step 825 at which the wall of the tubing string 110 may be perforated at a different location between a different set of flow diversion tools 200 or 600 uphole from the prior set of flow diversion tools 200 or 600. It should also be noted that in some applications the flow diversion tools 200 or 600 may be used as "service tools," which are moved around in the well and later retrieved after providing zonal isolation.

In some embodiments, a series of the flow diversion tools 200 and/or 600 may be inserted at predefined positions along a tubing string 110 (for example, fifty flow diversion tools 200 and/or 600 may be installed alternating between twenty foot or thirty foot lengths of tubing (i.e., "joints") along a run of a tubing string 110 as long as several miles), run into a wellbore casing 104, and permanently stuck in place by sand and formation debris. In these embodiments, the wellbore casing 104 and the tubing string 110 can be perforated between the flow diversion tools 200 and/or 600 to facilitate re-treating the well formation zones between the flow diversion tools 200 and/or 600 at high pressure and flow rate.

In other embodiments, a pair of flow diversion tools 200 and/or 600 may be mounted on a measured section of tubing, e.g., twenty feet long, and positioned within the wellbore casing 104 to isolate perforations for re-stimulation. After a section of the wellbore has been isolated and re-stimulated, the measured section of tubing with the flow diversion tools 200 and/or 600 at either end may be repositioned to straddle another section of the wellbore casing 104 to be isolated and re-stimulated. Eventually, the flow diversion tools 200 and/or 600 may be retrieved from the well in this embodiment. Embodiments of the flow diversion tool 200 and/or 600 are better suited to this application than systems using elastomeric seals, because elastomeric seals are sensitive and difficult to protect in comparison with the embodiments of the flow diversion tool 200 and/or 600.

Embodiments of the flow diversion tool 200 and 600 as discussed herein provide a robust, strong, well-protected annulus sealing device with high tensile and torque strengths that can more reliably reach operating depth within dirty and tortuous existing wellbores than devices of the prior art. At least some of the embodiments do not include threaded connections within the mandrel pipe 202 or 602, and therefore are stronger than devices of the prior art that do have threaded connections or joint connections between the ends of their respective mandrel pipes. This avoids weak tensile spots that may fail due to pressure from bending at the heel of a wellbore or high fluid pressure within. Unlike prior art devices incorporating elastomers, embodiments are resistant to corrosive chemicals used in wells such as hydrochloric acid, hydrogen sulfide, acetic acid, and xylene, as well as extremely hot environments. Some embodiments also provide a larger inner diameter than sealing devices of the prior art, facilitating "plug 'n' shoot" designs and better stimulation rates in re-stimulation operations. Embodiments support pressure isolation from both uphole and downhole directions, thereby providing flexibility in applications. Options to use both a high strength fiber cloth umbrella and tortuous paths in the cage surrounding the umbrella and to use tortuous paths in the cage without the umbrella beneath the cage effect adequate high pressure/flow seals. At low flow rates and pressures, or during installation of the flow diversion tool in a wellbore, embodiments provide desirable fluid bypass through the cage of the flow diversion tool, and adequately obstruct flow at high pressure/flow rates.

While embodiments have been described with reference to applications in wellbores for re-stimulation and re-frac'ing operations, this should not be construed as limiting. Embodiments may also be advantageously utilized in other applications, including initial wellbore stimulation, or any applications where sectional pressure and flow isolation and annular isolation within a length of tubing having an inner diameter slightly larger than an inner diameter of another length of tubing to be run within the larger diameter length of tubing is required, whether the larger diameter tubing is constructed of steel, PVC, or another material. For example, embodiments described herein may be utilized in wells that have had liner or casing failures during the initial completion phase. In such situations, pipe may have parted or failed in the heel of the well in early stages of frac'ing, possibly due to bending stresses on threaded connections. While these pipe failures result in stoppage of frac'ing operations, embodiments as disclosed herein may be utilized to restore frac'ing operations. For example, in accordance with at least one embodiment, the flow diversion tool (e.g., flow diversion tool 200 shown in FIG. 2 and described in detail above) may be utilized to "straddle" a troubled (e.g., parted or failed) portion of the pipe and repair the well. In addition, embodiments may be used in open boreholes 102 that do not include wellbore casings such as the wellbore casing 104, whether the open boreholes 102 comprise cement walls, gravel walls, rock walls, or walls of earth material in which the open boreholes 102 were drilled.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention. In the description of the embodiments, certain detailed explanations of related art are omitted when it is deemed that they may unnecessarily obscure the essence of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical". It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

GLOSSARY OF REFERENCE NUMERALS

100 wellbore system
102 borehole
104 wellbore casing
106 wellbore casing inner wall
108 wellbore annulus
110 tubing string
112 flow diversion tool
112' flow diversion tool
112" flow diversion tool
114 joint
114' joint
200 flow diversion tool
202 mandrel pipe
204 cage
206 fixed cage end
208 sliding cage end
210 tortuous path entrance
212 bow spring
214 downhole ring
216 uphole ring
218 solid outer diameter
220 mandrel pipe inner diameter
222 wellbore casing inner diameter
224 flow diversion tool total length
226 umbrella notch
228 umbrella
230 umbrella end
232 umbrella bottom
234 umbrella top
236 optional fluid flow path
238 tortuous path aperture
240 straight path
242 small circular path opening
244 large circular path opening
246 groove
248 petal
600 flow diversion tool
602 mandrel pipe
614 downhole ring
616 uphole ring
626 umbrella notch
628 umbrella
630 deployable umbrella end
632 fixed umbrella end
634 central umbrella region
636 optional fluid flow path

What is claimed is:

1. An apparatus for at least partially sealing an annulus of a wellbore, the apparatus comprising:

a mandrel pipe having two open ends adapted to attach to a tubing string; and a cylindrical cage surrounding and attached to an exterior length of the mandrel pipe, the cylindrical cage having a plurality of lengthwise tortuous path apertures parallel with one another between the two open ends of the mandrel pipe, the plurality of lengthwise tortuous path apertures defining a plurality of bow springs therebetween, the plurality of bow springs bowed outward from the mandrel pipe, wherein the tortuous path apertures comprise a series of circular openings connected by straight paths.

2. The apparatus of claim 1, further comprising at least one umbrella surrounding and attached to the exterior length of the mandrel pipe beneath the plurality of bow springs of the cylindrical cage, the at least one umbrella structurally configured to expand outward toward the plurality of bow springs when a fluid flows through the plurality of lengthwise tortuous path apertures adjacent the at least one umbrella at a flow rate greater than a threshold.

3. The apparatus of claim 2, wherein the at least one umbrella comprises a plurality of overlapping stainless steel slats.

4. The apparatus of claim 2, wherein the at least one umbrella comprises a carbon fiber cloth.

5. The apparatus of claim 2, wherein the at least one umbrella comprises a single umbrella configured for unidirectional fluid flow.

6. The apparatus of claim 2, wherein the at least one umbrella comprises two umbrellas, oriented opposite one another, and configured for bi-directional fluid flow.

7. The apparatus of claim 1, wherein the cylindrical cage comprises electroless nickel plated steel.

8. A method of re-stimulating a well using a flow diversion tool, the method comprising:

joining a flow diversion tool with a tubing string, the flow diversion tool including: a mandrel pipe having two open ends adapted to attach to the tubing string; and a cylindrical cage surrounding and attached to an exterior length of the mandrel pipe, the cylindrical cage having a plurality of lengthwise tortuous path apertures parallel with one another between the two open ends of the mandrel pipe, the plurality of lengthwise tortuous path apertures defining a plurality of bow springs therebetween, the plurality of bow springs bowed outward from the mandrel pipe, wherein the tortuous path apertures comprise a series of circular openings connected by straight paths;

inserting the tubing string joined with the flow diversion tool into a wellbore casing;

pumping fluid into a wellbore annulus between the tubing string and the wellbore casing;

flowing the pumped fluid through the plurality of tortuous path apertures of the flow diversion tool when the pressure of the pumped fluid is less than a free-flow threshold; and blocking the flow of the pumped fluid through the plurality of tortuous path apertures of the flow diversion tool when the pressure of the pumped fluid is greater than a blocking threshold.

9. The method of claim 8, wherein the flow diversion tool further includes at least one umbrella surrounding and attached to the exterior length of the mandrel pipe beneath the plurality of bow springs of the cylindrical cage, the at least one umbrella structurally configured to expand outward toward the plurality of bow springs when a fluid flows through the plurality of lengthwise tortuous path apertures adjacent the at least one umbrella at a pressure greater than the free-flow threshold; and the method further comprising:

pressing the at least one umbrella against the plurality of tortuous path apertures to block fluid flow through the plurality of tortuous path apertures when the pressure of the pumped fluid is greater than the blocking threshold; and relaxing the at least one umbrella to allow the pumped fluid to freely flow through the plurality of tortuous path apertures when the pressure of the pumped fluid is less than the free-flow threshold.

10. The method of claim 9, wherein when the pressure of the pumped fluid is greater than the blocking threshold, the fluid flows through the at least one umbrella at a reduced pressure.

11. The method of claim 9, wherein the at least one umbrella of the flow diversion tool comprises a plurality of overlapping stainless steel slats.

12. The method of claim 9, wherein the at least one umbrella of the flow diversion tool comprises a carbon fiber cloth.

13. The method of claim 9, wherein the at least one umbrella of the flow diversion tool comprises a single umbrella configured for uni-directional fluid flow through the flow diversion tool.

14. The method of claim 9, wherein the at least one umbrella of the flow diversion tool comprises two umbrellas, oriented opposite one another, and configured for bi-directional fluid flow through the flow diversion tool.

15. The method of claim 8, wherein the cylindrical cage of the flow diversion tool comprises electroless nickel plated steel.

* * * * *